US005213957A

United States Patent [19]

Adachi

[11] Patent Number: 5,213,957

[45] Date of Patent: May 25, 1993

[54] SILVER HALIDE PHOTOGRAPHIC LIGHT-SENSITIVE MATERIALS

[75] Inventor: Keiichi Adachi, Kanagawa, Japan

[73] Assignee: Fuji Photo Film Co., Ltd., Kanagawa, Japan

[21] Appl. No.: 908,741

[22] Filed: Jul. 6, 1992

Related U.S. Application Data

[63] Continuation of Ser. No. 811,923, Dec. 23, 1991, abandoned, which is a continuation of Ser. No. 618,421, Nov. 27, 1990, abandoned.

[30] Foreign Application Priority Data

Nov. 27, 1989 [JP] Japan ..... 1-307363

[51] Int. Cl.[5] ..... G03C 1/06

[52] U.S. Cl. ..... 430/522; 430/517

[58] Field of Search ..... 430/510, 517, 522, 585

[56] References Cited

U.S. PATENT DOCUMENTS

| | | | |
|---|---|---|---|
| 3,441,563 | 4/1969 | Weissel et al. . | |
| 3,627,532 | 12/1971 | Depoorter et al. | 430/522 |
| 3,746,539 | 7/1973 | Ohmatsu et al. | 430/522 |
| 4,311,787 | 1/1982 | Lemahieu et al. | 430/510 |
| 4,857,446 | 8/1989 | Diehl et al. | 430/510 |
| 4,933,268 | 6/1990 | Ohno et al. | 430/522 |
| 4,940,654 | 7/1990 | Diehl et al. | 430/510 |
| 4,948,717 | 8/1990 | Diehl et al. | 430/510 |
| 4.957,856 | 9/1990 | Suematsu et al. | 430/522 |
| 38965,817 | 2/1975 | Kobayashi et al. | 430/522 |

FOREIGN PATENT DOCUMENTS

| | | |
|---|---|---|
| 0299435 | 7/1988 | European Pat. Off. . |
| 1-196040 | 8/1989 | Japan . |

*Primary Examiner*—Jack P. Brammer

*Attorney, Agent, or Firm*—Sughrue, Mion, Zinn, Macpeak & Seas

[57] ABSTRACT

A silver halide photographic light-sensitive material, containing at least one type of dye represented by formula (I):

(I)

wherein A represents an acidic nucleus; $L_1$, $L_2$ and $L_3$ represent methine groups; Z represents non-metal atoms which form a five membered heterocyclic ring; n represents 0 or 1; and the dye comprises at least one group selected from a carboxyl group, a sulfonamido group and a sulfamoyl group.

4 Claims, No Drawings

SILVER HALIDE PHOTOGRAPHIC LIGHT-SENSITIVE MATERIALS

This is a continuation of application Ser. No. 07/811,923 filed Dec. 23, 1991, which is a continuation of application Ser. No. 07/618,421 filed Nov. 27, 1990.

FIELD OF THE INVENTION

This invention relates to silver halide photographic light-sensitive materials which have a colored hydrophilic colloid layer. More particularly, this invention relates to silver halide photographic light-sensitive materials which have a hydrophilic colloid layer which contains a dye which is inactive in terms of photographic chemistry and which is readily decolorized and/or washed out in photographic processing operations.

BACKGROUND OF THE INVENTION

The coloring of photographic emulsion layers or other layers is often carried out in silver halide photographic light-sensitive materials in order to absorb light of a specified wavelength.

When it is necessary to control the spectral composition of the light which should be incident on a photographic emulsion layer then a colored layer is positioned on the side of a photographic emulsion layer that is farthest from the support in the photographic light-sensitive material. Such a colored layer is known as a filter layer. In cases where there is a plurality of photographic emulsion layers, as in the case of a multi-layer color light-sensitive material, then filter layers may also be located between these layers.

Colored layers can also be established between the photographic emulsion layer and the support or on the opposite side of the support from that of the photographic emulsion layer, in order to prevent image blurring which is caused by scattered light produced when passing through a photographic emulsion layer or transmitted reflected by the interface between the emulsion layer and the support or reflected at the surface of the light-sensitive material on the opposite side of the emulsion layer and redirected into the photographic emulsion layer, the above scattered light prevention thereby preventing halation. Colored layers of this type are known as anti-halation layers. Antihalation layers can also be established between the various layers in the case of a multi-layer color light-sensitive material.

Moreover, colored layers are also provided in X-ray light-sensitive materials as cross-over cut filters for reducing the amount of cross-over light in order to increase the level of sharpness.

The coloration of photographic emulsion layers is also carried out in order to prevent any reduction in image sharpness due to light scattering within the photographic emulsion layer (this phenomenon is known generally as irradiation).

These layers which are to be colored in many cases comprise a hydrophilic colloid layer and so dyes are normally included in the layers in order to achieve the desired coloration. The dyes used must at least satisfy the following conditions:

(1) they must have a spectral absorption which is suitable for their intended use;

(2) they must be photographically inactive, i.e., they must have no adverse chemical effects on the performance of the silver halide photographic emulsion layer, such as reduction of photographic sensitivity, latent image regression or fogging; and (3) they must be decolorized and/or dissolved out and removed from the photographic material during the course of the photographic processing operations, without deleterious coloration remaining in the photographic light-sensitive material after processing.

Much work has been carried out by those in this field in order to find dyes which satisfy these conditions and include the following known dyes. For example, there are oxonol dyes which have a pyrazolone nucleus or a barbituric acid nucleus disclosed, for example, in British Patents 506,385, 1,177,429, 1,311,884, 1,338,799, 1,385,371, 1,467,214, 1,433,102 and 1,553,516, JP-A-48-85130, JP-A-49-114420, JP-A-50-147712, JP-A-55-161233, JP-A-58-143342, JP-A-59-38742, JP-A-59-111641, JP-A-59-111640, and U.S. Pat. Nos. 3,247,127, 3,469,985 and 4,078,933; other oxonol dyes disclosed, for example, in U.S. Pat. Nos. 2,533,472 and 3,379,533, and British Patent 1,278,621; azo dyes disclosed, for example, in British Patents 575,691, 680,631, 599,623, 786,907, 907,125 and 1,045,609, U.S. Pat. No. 4,255,326, and JP-A-59-211043; azomethine dyes disclosed, for example, in JP-A-50-100116, JP-A-54-118247 and British Patents 2,014,598 and 750,031; anthraquinone dyes disclosed in U.S. Pat. No. 2,865,752; arylidene dyes disclosed, for example, in U.S. Pat. Nos. 2,538,009, 2,688,541 and 2,538,008, British Patents 584,609, 1,210,252, JP-A-50-40625, JP-A-51-3623, JP-A-51-10927, JP-A-54-118247, JP-B-48-3286 and JP-B-59-37303; styryl dyes disclosed, for example, in JP-B-28-3082, JP-B-44-16594 and JP-B-59-28898; triarylmethane dyes disclosed, for example, in British Patents 446,583 and 1,335,422, and JP-A-59-228250; merocyanine dyes disclosed, for example, in British Patents 1,075,653, 1,153,341, 1,284,730, 1,475,228 and 1,542,807; and cyanine dyes disclosed, for example, in U.S. Pat. Nos. 2,843,486 and 3,294,539. (The terms "JP-A" and "JP-B" as used herein signify an "unexamined published Japanese patent application" and an "examined Japanese patent publication" respectively.)

From among these dyes, while oxonol dyes having two pyrazolone nuclei have the property of being decolorized in developers which contain sulfite, they have little adverse action on photographic emulsions and they have therefore been used as useful dyes for light-sensitive materials.

However, even though such dyes have little effect on the photographic emulsion itself, some of these dyes provide spectral sensitization of a spectrally sensitized emulsion in an unsuitable spectral region and also have a disadvantage that results in reduction of photographic sensitivity, apparently caused by decolorization of the sensitizing dyes.

Furthermore, residual coloration remains after processing using such dyes as a result of faster development processing rates which have been used in recent years. The use of dyes which have a higher reactivity with sulfite ion has been proposed as a means of overcoming this problem, but in such cases the stability in the photographic film becomes unsatisfactory, a reduction in density occurs with the passage of time and the prescribed photographic effect is not obtained.

Additionally, when the colored layer is a filter layer or an anti-halation layer located on the same side of the support as the photographic emulsion layer, it is generally required that the layers be selectively colored and spreading of the coloration to other layers prevented.

Failure to meet these requirements results in reduced efficiency of the colored layer as a filter layer or antihalation layer and adverse spectral actions on the other photographic emulsion layers. There are various methods of selectively coloring a specified hydrophilic colloid layer, but, most frequently, methods are used wherein a hydrophilic polymer, containing a portion oppositely charged to that of the dye ion, is included in a hydrophilic layer as a mordant. Such polymers are included in specified emulsion layers having the dye localized by the interaction between the polymer and the dye molecule (due to an attraction by the charge and hydrophobic bonding).

However, when such a mordanting method is used, some of the dye frequently diffuses from the layer to which it has been added to another hydrophilic layer when the layers are in contact under wet conditions such as during processing. Such diffusion of the dyes depends on the chemical structure of the mordant, but it also depends on the chemical structure of the dye which is being used.

Furthermore, residual coloration of the light-sensitive material after photographic processing, and especially after photographic processing with shortened processing times, is likely to occur when a macromolecular mordant is used. This is thought to be due to the fact that, although the bond strength between the mordant and the dye becomes weaker in an alkali solution such as a developer, the bond strength remaining is sufficient to cause the dye or reversible decoloration products to remain in the layer which contains the mordant.

Furthermore, the inclusion of dyes, as disperse solids, is known as another means of retaining the dye in a specified layer of a photographic light-sensitive material, as has been disclosed, for example in JP-A-56-12639, JP-A-52-92716, JP-A-55-155350, JP-A-55-155351, JP-A-52-92716, JP-A-63-27838, JP-A-63-197943, European Patents 0015601B1, 0276566A1, 274723, 276566 and 299435, and Published Unexamined International Application No. 1-502912. However, diffusion of these dyes to other layers has been found to occur and, especially when rapid processing is carried out, some residual coloration of the dye remains in the light-sensitive material. Thus, a need exists to provide colored layers in photographic light-sensitive materials that lack the above-described problems of residual coloration, adverse effects on performance, adverse spectral sensitization shifts, and adverse effects on film aging.

SUMMARY OF THE INVENTION

Hence, one object of the present invention is to provide silver halide photographic light-sensitive materials having a hydrophilic colloid layer that is colored with a dye which is decolorized irreversibly by photographic processing and which has no adverse effect on the photographic and developing characteristics of the photographic emulsion.

Another object of the present invention is to provide silver halide photographic light-sensitive materials which have a hydrophilic colloid layer in which only the prescribed hydrophilic colloid layer is selectively dyed and which has excellent decolorizing properties upon photographic processing.

Still another object of the present invention is to provide silver halide photographic light-sensitive materials having a dyed hydrophilic colloid layer which has no adverse effect on the photographic characteristics of the silver halide emulsion layer even when the dyed hydrophilic colloid layer is aged.

In one embodiment, the aforementioned objects have been achieved by a silver halide photographic light-sensitive material comprising at least one dye represented by formula (I):

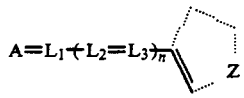

(I)

wherein A represents an acidic nucleus; $L_1$, $L_2$ and $L_3$ represent substituted or unsubstituted methine groups; Z represents non-metal atoms which form a five membered heterocyclic ring; n represents 0 or 1; the dye comprises at least one group selected from a carboxyl group, a sulfonamido groups and a sulfamoyl group.

In another embodiment, the above-mentioned objects are also met by a silver halide photographic light-sensitive material, wherein the material comprises at least one dye of formula (I) present in the form of a fine powder dispersion.

In still another embodiment, the above-mentioned objects of the present invention are further met by a silver halide photographic light-sensitive material wherein the acidic nucleus A of formula (I) is selected from the group consisting of a 5-pyrazolone, isooxazolone, barbituric acid, thiobarbituric acid, rhodanine, hydantoin, thiohydantoin, oxazolidindione, pyrazolidindione, indandione, pyrazolopyridone, 1,2,3,4-tetrahydroquinolin-2,4-dione, 3-oxo-2,3-dihydrobenzo[d]-thiophene-1,1-dioxide, or 3-dicyanomethine-2,3-dihydroxybenzo[d]thiophene-1,1-dioxide nucleus.

In another embodiment, the above objects of the present invention are met by a silver halide photographic light-sensitive material wherein the dye according to formula (I) has formula (II):

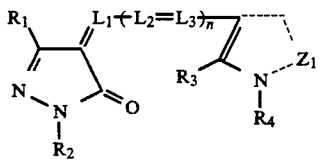

(II)

wherein $R_1$ represents an alkyl, aryl, alkoxycarbonyl, aryloxycarbonyl, alkoxy, aryloxy, acyl, hydroxy, acylamino, cyano, ureido or amino group; $L_1$, $L_2$ and $L_3$ represent substituted or unsubstituted methine groups; $R_2$ represents an aryl or aryloxy group; $R_3$ and $R_4$ represent alkyl, aryl or alkoxycarbonyl groups or hydrogen atoms; $Z_1$ represents non-metal atoms which form a five membered heterocyclic ring; the heterocyclic ring optionally comprising a condensed benzene ring; n represents 0 or 1; and the dye has at least one group selected from the group consisting of a carboxyl group, a sulfonamido group and a sulfamoyl group.

Still another embodiment meets the above objects of the present invention as a silver halide photographic light-sensitive material, comprising at least one fine powder dispersion of a dye represented by formula (II) and a fine powder dispersion of a dye represented by formula (III);

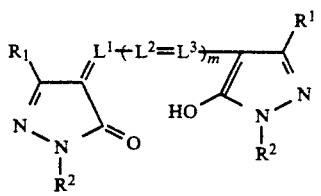

(III)

wherein $R^1$, $R^2$, $L^1$, $L^2$ and $L^3$ each are the same as $R_1$, $R_2$, $L_1$, $L_2$ and $L_3$ in formula (II) above; two $R^1$'s or two $R^2$'s may be the same or different from each other; m represents 0, 1 or 2; and the dye comprises at least one group selected from the group consisting of a carboxyl group, a sulfonamido group and a sulfamoyl group.

DETAILED DESCRIPTION OF THE INVENTION

Formula (I) is described in detail as follows.

A in formula (I) represents an acidic nucleus. Preferred acidic nuclei include 5-pyrazolone, isooxazolone, barbituric acid, thiobarbituric acid, rhodanine, hydantoin, thiohydantoin, oxazolidindione, pyrazolidindione, indandione, pyrazolopyridone, 1,2,3,4-tetrahydroquinolin-2,4-dione, 3-oxo-2,3-dihydrobenzo[d]thiophene-1,1-dioxide and 3-dicyanomethine-2,3-dihydrobenzo[d]thiophene-1,1-dioxide, and the acidic nucleus is preferably selected from the group consisting of 5-pyrazolone, isooxazolone, barbituric acid, oxazolidindione, pyrazolidindione, indandione and pyrazolopyridone nuclei. The acidic nucleus may have a substituent. Heterocyclic rings formed by Z are selected from the group consisting of pyrrole, indole, pyrazole, pyrazolopyrimidone and benzindole rings. Moreover, n represents 0 or 1.

Dyes represented by formula (I) wherein an acidic nucleus for A has a carboxyl group, n represents 0, and a 5-membered heterocyclic ring for Z is an indole ring or a pyrrole ring are preferred.

Formula (II) is described in detail as follows.

In formula (II), $R_1$ preferably represents, for example, a substituted or unsubstituted alkyl group which has from 1 to 4 carbon atoms (for example, methyl, ethyl, butyl, t-butyl, 2-chloroethyl, methoxyethyl, 2-hydroxyethyl, trifluoromethyl), a substituted or unsubstituted aryl group which has from 6 to 10 carbon atoms (for example, phenyl, tolyl, methoxyphenyl, chlorophenyl, naphthyl, carboxyphenyl), a substituted or unsubstituted alkoxy group which has from 1 to 4 carbon atoms (for example, methoxy, ethoxy, butoxy, methoxyethoxy), a substituted or unsubstituted alkoxycarbonyl group which has from 2 to 5 carbon atoms (for example, methoxycarbonyl, ethoxycarbonyl, 2-methoxyethoxycarbonyl, butoxycarbonyl), a substituted or unsubstituted aryloxycarbonyl group which has from 7 to 12 carbon atoms (for example, phenoxycarbonyl, methoxyphenylcarbonyl, chlorophenylcarbonyl, methylphenylcarbonyl), a substituted or unsubstituted aryloxy group which has from 6 to 10 carbon atoms (for example, phenoxy, methoxyphenoxy), an acyl group which has from 2 to 5 carbon atoms (for example, acyl, propionyl, butanoyl), a hydroxy group, a cyano group, an acylamino group which has from 2 to 10 carbon atoms (for example, acetylamino, benzoylamino), a ureido group (for example, methylureido, ethylureido), or an amino group (for example, dimethylamino, diethylamino, phenylamino, chlorophenylamino, methoxyphenylamino). $R_2$ preferably represents, for example, a substituted or unsubstituted aryl group which has from 6 to 12 carbon atoms (for example, phenyl, p-carboxyphenyl, 3,5-dicarboxyphenyl, o-carboxyphenyl, chlorophenyl, methoxyphenyl, methylphenyl), or a substituted or unsubstituted aralkyl group which has from 7 to 12 carbon atoms (for example, benzyl, 2-carboxybenzyl), and $R_3$ and $R_4$ preferably represent, for example, hydrogen atoms, substituted or unsubstituted alkyl groups which have from 1 to 10 carbon atoms (for example, methyl, ethyl, propyl, cyanoethyl, methoxyethyl, benzyl, carboxybenzyl), or substituted or unsubstituted aryl groups which have from 6 to 12 carbon atoms (for example, phenyl, p-dimethylaminophenyl, p-diethylamino-o-methylphenyl, 2,4,6-trimethylphenyl, p-carboxyphenyl, p-ethoxycarbonylphenyl, p-methanesulfonylaminophenyl). The heterocyclic ring formed by $Z_1$ is preferably, an indole, pyrrole or pyrazole ring, for example. Moreover, n represents 0 or 1. However, the molecule contains at least one group selected from among carboxyl, sulfamoyl and sulfonamido groups. Furthermore, these groups are preferably bonded to an aryl group within the molecule. The carboxyl group is the most preferred of these groups.

Formula (III) is described as follows. In formula (III), $R_1$ and $R_2$ have the same significance as $R_1$ and $R_2$ respectively in formula (II), and m represents 0, 1 or 2.

Actual examples of compounds of the present invention are indicated below, but the present invention is not limited by these examples.

Examples of Formulae (I) and (II), Wherein n=0, According to Formula (II-A), as Follows

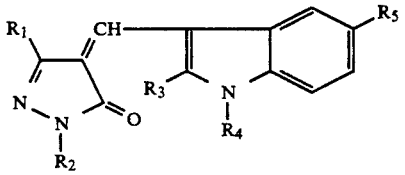

| No. | $R_1$ | $R_2$ | $R_3$ | $R_4$ | $R_5$ |
|---|---|---|---|---|---|
| 1 | $-CH_3$ | 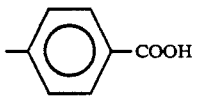 | H | H | H |
| 2 | $-C_2H_5$ | " | H | H | H |
| 3 | $-COOC_2H_5$ | " | H | H | H |

-continued
| | | | | | |
|---|---|---|---|---|---|
| 4 | $-OC_2H_5$ | " | H | H | H |
| 5 | 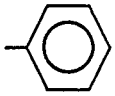 | " | H | H | H |
| 6 | $-OH$ | " | H | H | H |
| 7 | $-COOH$ | " | H | H | H |
| 8 | $-CH_3$ | " | H | $-CH_3$ | H |
| 9 | $-COOC_2H_5$ | " | H | $-CH_3$ | H |
| 10 | $-CH_3$ | " | 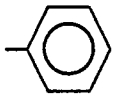 | $-CH_3$ | H |
| 11 | $-CH_3$ | 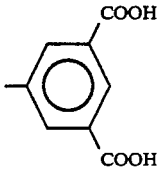 | " | $-CH_3$ | H |
| 12 | $-CH_3$ | 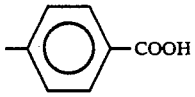 | $-CH_3$ | $-CH_3$ | H |
| 13 | $-CH_3$ | " | $-COOC_2H_5$ | H | H |
| 14 | $-CH_3$ | " | $-COOC_2H_5$ | $-CH_3$ | H |
| 15 | $-CH_3$ | " | $-Cl$ | $-C_2H_5$ | H |
| 16 | $-CH_3$ | " | H | H | $OCH_3$ |
| 17 | $-COOC_2H_5$ | " | H | 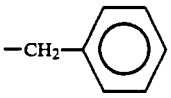 | H |
| 18 | $-CH_3$ | " | 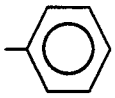 | H | H |
| 19 | $-CH_3$ | " | H | H | Cl |
| 20 | $-CH_3$ | " | H | H | $CH_3$ |
| 21 | $-CH_3$ | 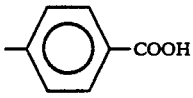 | H | $-C_2H_5$ | H |
| 22 | $-CH_3$ | 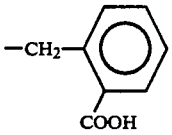 | H | $-CH_3$ | H |
| 23 | $-COOC_2H_5$ | 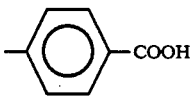 | $-CH_3$ | $-C_2H_5$ | H |
| 24 | $-CH_3$ | " | " | $-CH_3$ | $-NO_2$ |

-continued
| | | | | | |
|---|---|---|---|---|---|
| 25 | $-CH_3$ | 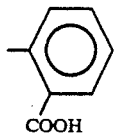 | $-CH_3$ | $-CH_3$ | H |
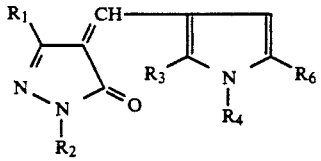
| No. | $R_1$ | $R_2$ | $R_3$ | $R_4$ | $R_5$ |
|---|---|---|---|---|---|
| 26 | $-CH_3$ | 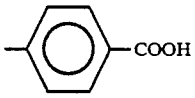 | $-CH_3$ | 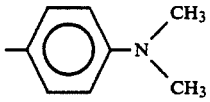 | $-CH_3$ |
| 27 | $-COOC_2H_5$ | " | " | 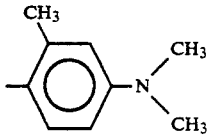 | " |
| 28 | $-CH_3$ | " | " | 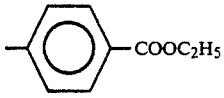 | " |
| 29 | " | 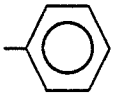 | " | 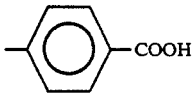 | " |
| 30 | $-CN$ | " | " | " | " |
| 31 | $-COOC_2H_5$ | " | " | 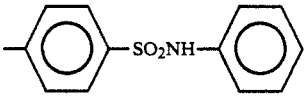 | " |
| 32 | $-CH_3$ | 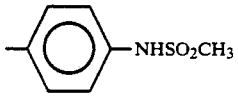 | " | 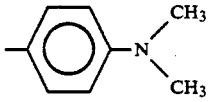 | " |
| 33 | $-CH_3$ | 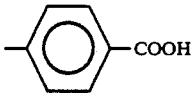 | 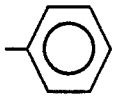 | 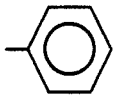 | 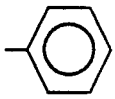 |
| 34 | $-NHCONHCH_3$ | 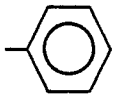 | $-CH_3$ | 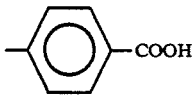 | $-CH_3$ |
| 35 | 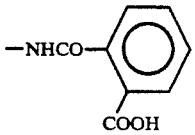 | 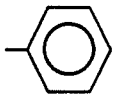 | " | 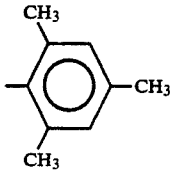 | " |

Examples of Formulae (I) and (II), Wherein n=0 or 1.
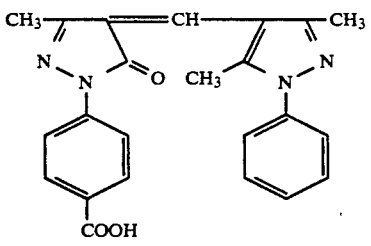
36
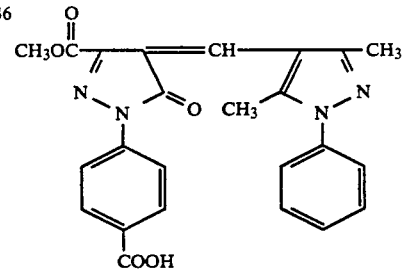
37
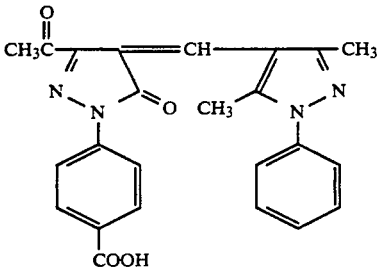
38
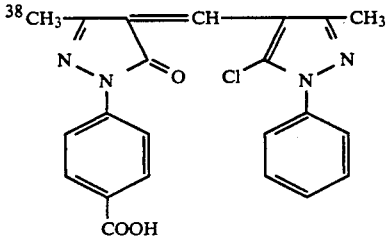
39
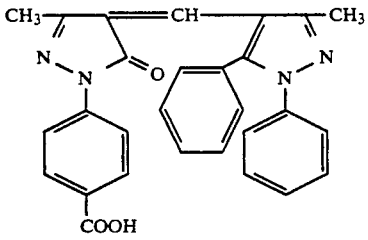
40
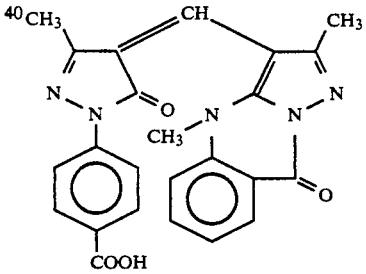
41
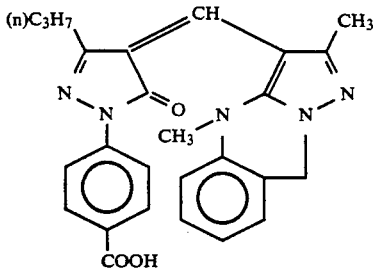
42
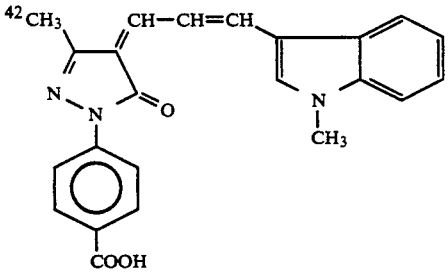
43
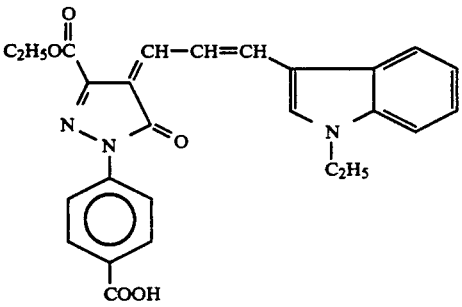
44
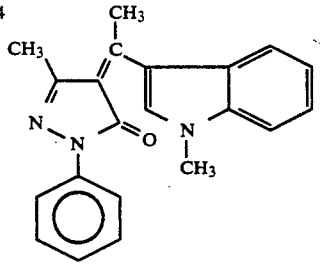
45

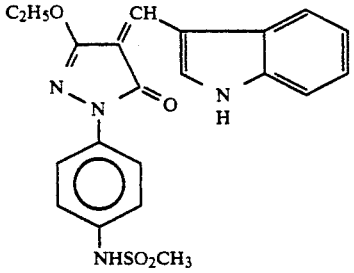
-continued
46
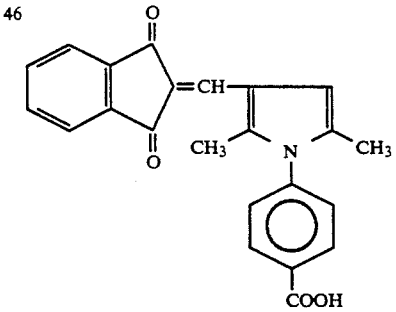
47
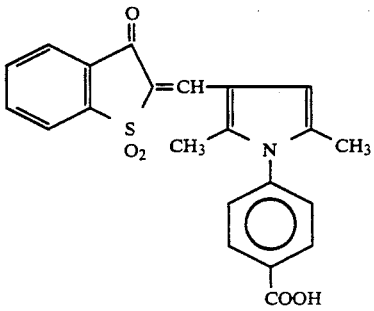
48
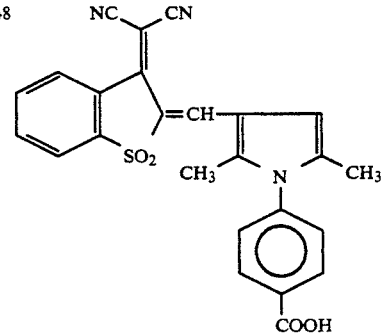
49
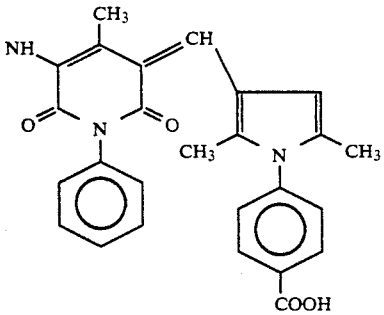
50
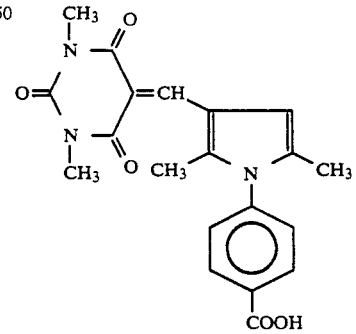
51
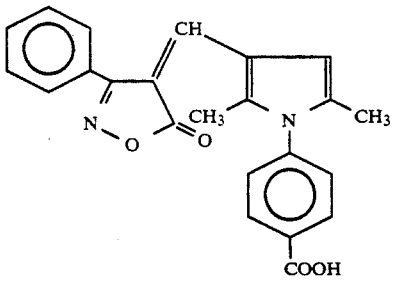
52
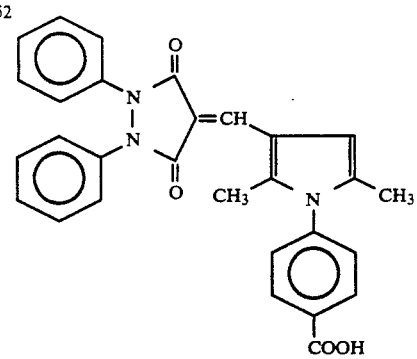
53
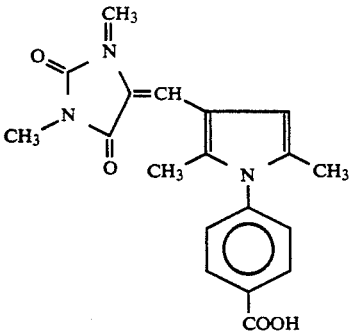
54
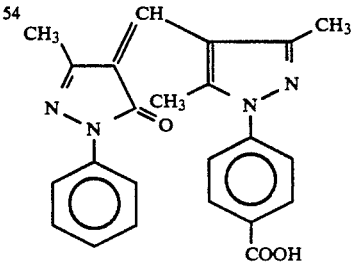
55

-continued
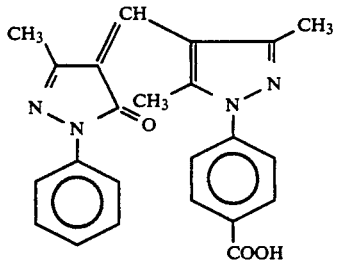
56
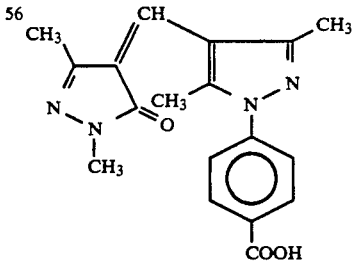
57
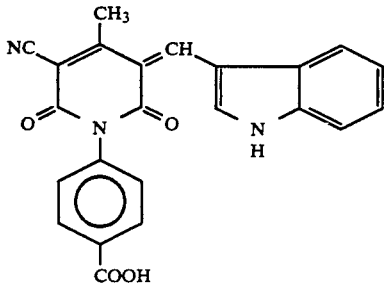
58
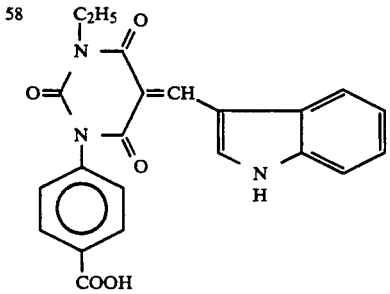
59
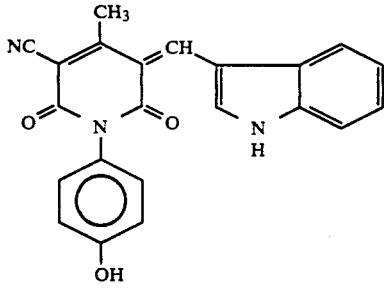
60
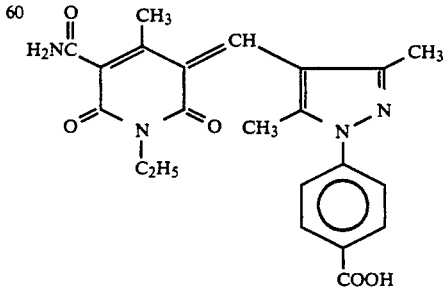
61
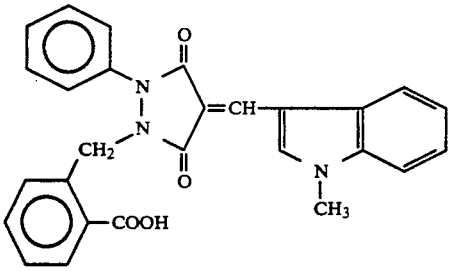
62
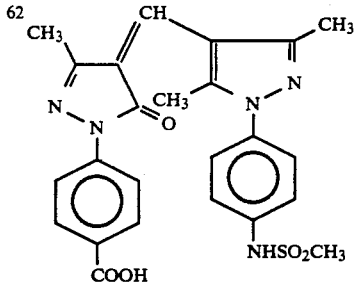
63
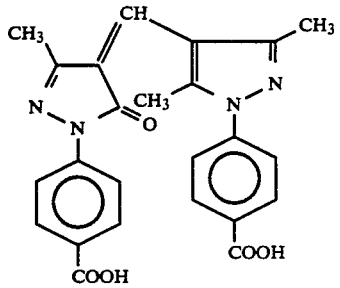
64
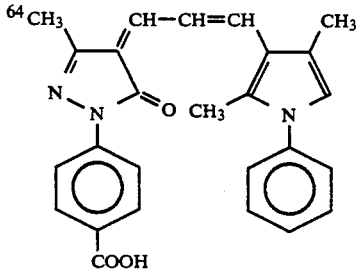
65

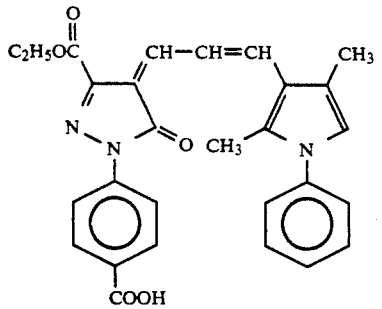
-continued
66
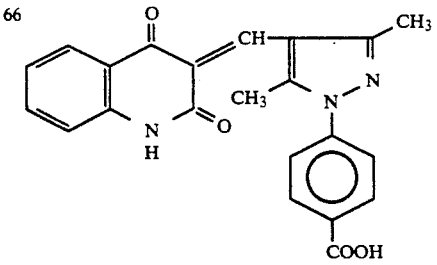
67
68
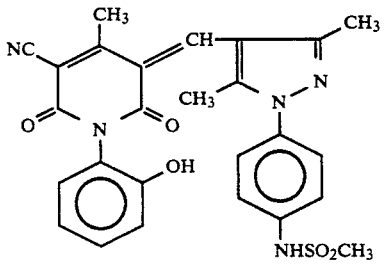
69
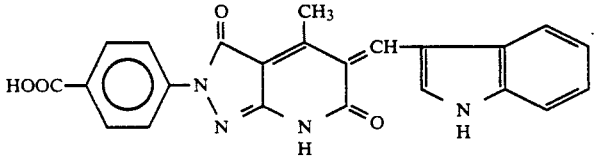
70
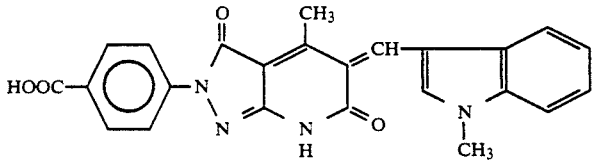
71
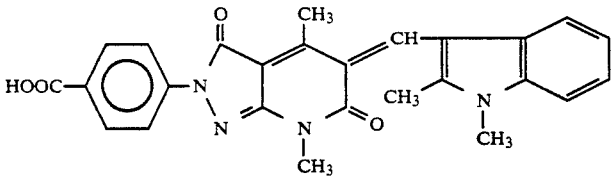
72
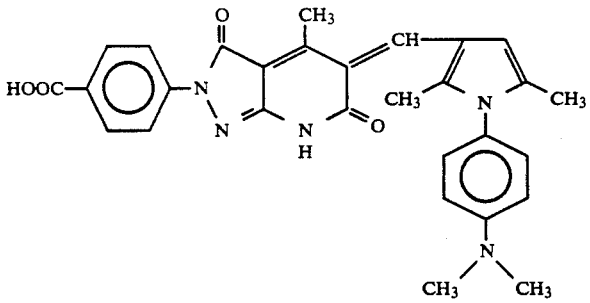
Examples of Formula (III)
| | $R_1$ | $R_2$ | m |
|---|---|---|---|
| III-1 | $CH_3$ | 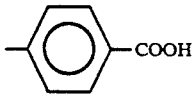 | 0 |
Compounds 1 to 14, 26 to 28, 43, 44, 59, 65, 66 and 69 to 72 are particularly preferred.

-continued

| | $R_1$ | $R_2$ | m |
|---|---|---|---|
| III-2 | " | " | 1 |
| III-3 | " | " | 2 |
| III-4 | $C_2H_5OC(=O)-$ | " | 0 |
| III-5 | " | " | 1 |
| III-6 | " | " | 2 |
| III-7 | $C_2H_5O$ | " | 2 |
| III-8 | $CH_3CONH-$ | " | 1 |
| III-9 | " | " | 2 |
| III-10 | $(CH_3)_2N-$ | " | 2 |
| III-11 | NC— | " | 2 |
| III-12 | $CH_3CO-$ | 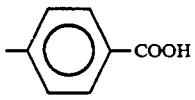 | 2 |
| III-14 | $CH_3$ | 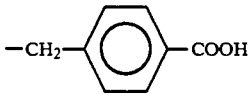 | 2 |
| III-15 | $CF_3-$ | 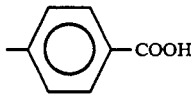 | 2 |
| III-16 | $CH_3OC(=O)-$ | " | 2 |
| III-17 | $CH_3$ | 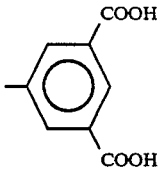 | 0 |
| III-18 | " | " | 1 |
| III-19 | " | " | 2 |
| III-20 | 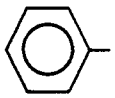 | " | 2 |
| III-21 | " | 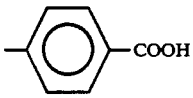 | 2 |
| III-22 | $C_2H_5-$ | " | 1 |
| III-23 | " | " | 2 |
| III-24 | $CH_3NHCO-$ | 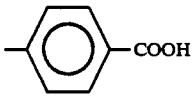 | 2 |
| III-25 | $CH_3NHC(=O)NH-$ | " | 2 |

The compounds of formulae (I) and (II) as used in the present invention can be prepared using the methods disclosed, for example, in JP-A-63-197943, JP-A-54-118247, JP-A-59-154439 and JP-A-56-12639 the contents of which are herein incorporated by reference. Examples of synthesis are indicated below.

Synthesis Example 1 (Compound 1)

1-p-Carboxyphenyl-3-methyl-5-pyrazolone (5 grams) and 3.7 grams of 3-formylindole were mixed with 60 ml of ethanol and heated under reflux for 4 hours. The mixture was then cooled to room temperature and, after recovering the yellow crystals which precipitated out by filtration, the crystals were washed with a small amount of ethanol and dried, whereupon 7.3 grams of Compound 1 was obtained. The melting point was above 300° C.

Synthesis Example 2 (Compound 3)

The same procedure as described in Synthesis Example 1 was followed using 6.9 grams of 1-p-carboxyphenyl-3-ethoxycarbonyl-5-pyrazolone and 4.0 grams of 3-formylindole as starting materials and 7 grams of Compound 3 was obtained. The melting point was above 300° C.

Synthesis Example 3 (Compound 8)

The same procedure as described in Synthesis Example 1 was followed using 5.4 grams of 1-p-carboxy-3-methyl-5-pyrazolone and 4.4 grams of 3-formyl-1-methylindole as starting materials and 8 grams of Compound 8 was obtained. The melting point was above 300° C.

Synthesis Example 4 (Compound 18)

The same procedure as described in Synthesis Example 1 was followed using 5.4 grams of 1-p-carboxy-3-methyl-5-pyrazolone and 5.5 grams of 3-formyl-2-phenylindole as starting materials and 7.5 grams of Compound 18 was obtained. The melting point was above 300° C.

Synthesis Example 5 (Compound 26)

1-p-Carboxy-3-methyl-5-pyrazolone (5.4 grams) and 6.0 grams of 2,5-dimethyl-1-p-dimethylaminophenyl-3-formylpyrrole were mixed with 60 ml of ethanol and heated under reflux for 2 hours. After cooling to room temperature, the product was filtered off and washed with ethanol and 9.4 grams of Compound 26 was obtained. The melting point was above 300° C.

Synthesis Example 6 (Compound 40)

1-p-Carboxyphenyl-3-methyl-5-pyrazolone (4.7 grams) and 6.0 grams of 1,5-diphenyl-4-formyl-3-methylpyrazole were mixed with 50 ml of ethanol and heated under reflux for 4 hours. The mixture was filtered hot without stopping the reflux, the product was washed with cold ethanol and 9.1 grams of Compound 40 was obtained. The melting point was above 298° C. to 299° C.

Compounds of formula (III) used in the present invention can be prepared using the methods disclosed in JP-A-64-40827, JP-A-52-92716 and Japanese Patent Application No. 1-142683, the contents of which are herein incorporated by reference.

Synthesis Example 7 (Compound III-3)

1-p-Carboxy-3-methyl-5-pyrazolone (2.2 grams) was mixed with 15 ml of dimethylformamide and 3.5 ml of triethylamine was added to form a solution. Next 1.4 grams of glutaconaldehydodianil was added at room temperature and the mixture was stirred for 2 hours. Concentrated hydrochloric acid (2 ml) was then added dropwise with cooling and 2.2 grams of Compound III-3 was obtained on recovering the crystals which precipitated out by filtration. The melting point was above 300° C.

In general, dyes of formula (I) are used in a range of from about 1 to 1000 mg, and preferably in a range of from about 1 to 800 mg in all layers, per square meter surface area of light-sensitive material.

When dyes represented by formula (I) are used as filter dyes or anti-halation dyes according to the present invention they can be used in any amount which is effective, but they are preferably used in an amount such that the optical density is within the range from about 0.05 to 3.5, and preferably from 0.1 to 3.0. The dyes can be added at any stage prior to coating.

Dyes used in accordance with the present invention can be used in any emulsion layer or other hydrophilic colloid layer. The dyes are preferably used in a light-insensitive layer.

Methods of dispersing dyes of the present invention as a fine powder dispersion include the dissolution of the dye in a weakly alkaline solution and addition to a hydrophilic colloid layer to form a fine crystalline dispersion by adjusting the pH to a weak acidic conditions. Alternatively, fine powder dispersion of dyes are accomplished by known milling methods, for example ball milling, sand milling or colloid milling, used in the presence of a dispersing agent. Furthermore, the dye may be dissolved in a suitable solvent, for example, an alcohol or a halogenated alcohol (e.g., as disclosed in JP-A-48-9715), acetone, water or pyridine, or in a mixture of these solvents, and a fine particle powder can be precipitated by adding a poor solvent to the solution.

Dye particles in the dispersion as used in the present invention have an average particle size of up to about 10 μm, preferably up to about 2 μm, and most desirably up to about 0.5 μm and, depending on the particular use, fine particles up to about 0.1 μm are especially desirable.

Other methods of dispersing dyes into a hydrophilic colloid layer include dissolving dyes in an essentially water insoluble, high boiling point (above about 160° C.) ester solvent and the dispersing the dye-solvent in a hydrophilic colloid solvent. Examples of such high boiling point solvents which can be used in the present invention include phthalic acid alkyl esters (for example, dibutyl phthalate, dioctyl phthalate), phosphate esters (for example, diphenyl phosphate, triphenyl phosphate, tricresyl phosphate, dioctyl butyl phosphate), citric acid esters (for example, tributyl acetylcitrate), benzoic acid esters (for example, octyl benzoate), alkylamides (for example, diethyllaurylamide), fatty acid esters (for example, dibutoxyethyl succinate, diethyl azelate), trimesic acid esters (for example, tributyl trimesitate).

Furthermore, organic solvents of boiling point from about 30° C. to 150° C., for example lower alkyl acetates such as ethyl acetate and butyl acetate, ethyl propionate, sec-butyl alcohol, methyl isobutyl ketone, β-ethoxyethyl acetate, methycellosolve acetate, and solvents which are readily dissolved in water, for example alcohols such as methanol and ethanol, can be used in the present invention.

Here, the ratio (by weight) in which the dye and the high boiling point solvent are used is preferably from about 10 to 1/10.

Alternative methods in which a dye of the present invention and other additives are incorporated into photographic emulsion layers or other hydrophilic colloid layers include the use of filling polymer latex components.

Examples of the aforementioned polymer latexes include, for example, polyurethane polymers and polymers obtained by polymerization from vinyl monomers [suitable vinyl monomers include acrylic acid esters (for example, methyl acrylate, ethyl acrylate, butyl acrylate, hexyl acrylate, octyl acrylate, dodecyl acrylate, glycidyl acrylate), α-substituted acrylic acid esters (for example, methyl methacrylate, butyl methacrylate, octyl methacrylate, glycidyl methacrylate), acrylamides (for example, butylacrylamide, hexylacrylamide), α-substituted acrylamides (for example, butyl methacrylamide, dibutylmethacrylamide), vinyl esters (for example, vinyl acetate, vinyl butyrate), vinyl halides (for example, vinyl chloride), vinylidene halides (for example, vinylidene chloride), vinyl ethers (for example, vinyl methyl ether, vinyl octyl ether), styrene, α-substituted styrenes (for example, α-methylstyrene), ring substituted styrenes (for example, hydroxystyrene, chlorostyrene, methylstyrene), ethylene, propylene, butylene, butadiene and acrylonitrile), and these can be used individually or in combinations of two or more, or in the form of mixtures with other vinyl monomers as minor components, such other vinyl monomers including, for example, itaconic acid, acrylic acid, methacrylic acid, hydroxyalkyl acrylates, hydroxyalkyl methacrylates, sulfoalkyl acrylates, sulfoalkyl methacrylates and styrene sulfonic acid for example].

These filled polymer latexes can be prepared using the methods disclosed in JP-B-51-39853, JP-A-51-59943, JP-A-53-137131, JP-A-54-32552, JP-A-54-107941, JP-A-55-133465, JP-A-56-19043, JP-A-56-19047, JP-A-56-126830 and JP-A-58-149038, the contents of which are herein incorporated by reference.

Here, the ratio of the amounts (by weight) of the dye (or additive) and polymer latex used is preferably from about 10 to 1/10.

Further, methods in which the dye compounds are incorporated into hydrophilic colloid layers include dissolving the dye using a surfactant, according to another aspect of the present invention. Useful surfactants may be oligomers or polymers. Details of these polymers have been disclosed in JP-A-60-158437, the contents of which are herein incorporated by reference.

Additional methods in which hydrophilic polymers are used, instead of the high boiling point solvent in the second method above, or in conjunction with these high boiling point solvents, can be used in the present invention to incorporated dyes into hydrophilic colloid layers. Disclosures have been made in connection with these methods in, for example, U.S. Pat. No. 3,619,195 and West German Patent 1,957,467, the contents of which are herein incorporated by reference.

Microencapsulation methods can also be used to incorporate dyes into hydrophilic colloid layers with polymers which have carboxyl groups or sulfo groups, for example, in a side chain, as disclosed in JP-A-59-113434. Furthermore, the lipophilic polymer hydrosols disclosed, for example, in JP-B-51-39835 may be added to the hydrophilic colloid dispersions obtained in the way described above.

Gelatin is a typical and preferred hydrophilic colloid, but any other known hydophilic colloids which can be used in photographic applications known can alternatively be used.

Among the dispersing methods described above, the first method and the second method are preferred Silver halide emulsions which are used in silver halide photographic light-sensitive materials of the present invention and light-sensitive materials of the present invention are described in detail below.

Silver halide emulsions used in the present invention are preferably silver bromide, silver iodobromide, silver iodochlorobromide, silver chlorobromide or silver chloride emulsions.

Silver halide grains which are used in the present invention may have a regular crystalline form (such as a cubic or octahedral form); an irregular crystalline form (such as a spherical or tabular form); or a composite form comprised of combination of the above-mentioned crystalline forms. Furthermore, emulsions comprised of mixtures of grains of various crystalline forms can also be used, but the use of grains which have a regular crystalline form is preferred.

Silver halide grains which are used in the present invention may be such that the interior part and the surface layer form different phases, each containing the grains, or the grains may consist of a uniform phase. Furthermore, the grains may be of the type with which the latent image is formed principally on the surface (for example, negative type emulsions) or of the type with which the latent image is formed principally within the grains (for example, internal latent image type emulsions, pre-fogged direct reversal type emulsions). Grains of the type with which the latent image is formed principally on the surface are preferred.

Silver halide emulsions used in the present invention preferably comprise tabular grains emulsions in which grains of thickness of up to about 0.5 microns, and preferably up to about 0.3 microns, and of diameter preferably at least about 0.6 microns, and which have an average aspect ratio of at least about 5, account for at least about 50% of the total projected area. Alternatively to tabular grain emulsions, mono-disperse emulsions can be used, wherein the statistical variation coefficient (the value $S/\bar{d}$ obtained by dividing the standard deviation S by the diameter $\bar{d}$ for a distribution represented by the diameters in cases where the projected areas are approximately circular) is up to about 20%. Furthermore, two or more types of tabular grain emulsion and mono-disperse emulsion may be used in combination.

Photographic emulsions used in the present invention can be prepared using the methods described, for example, by P. Glafkides in *Chimie et Physique Photographique*, published by Paul Montel, 1967, by G. F. Duffin in *Photographic Emulsion Chemistry*, published by Focal Press, 1966, and by V. L. Zelikman et al. in *Making and Coating Photographic Emulsions*, published by Focal Press, 1964.

Furthermore, ammonia, potassium thiocyanate, ammonium thiocyanate, thioether compounds (for example, those disclosed, for example, in U.S. Pat. Nos. 3,271,157, 3,574,628, 3,704,130, 4,297,439 and 4,279,374), thione compounds (for example, those disclosed, for example, in JP-A-53-144319, JP-A-53-82408 and JP-A-55-77737), and amine compounds (for example, those disclosed in JP-A-54-100717) can be used as silver halide solvents for controlling grain growth during silver halide grain formation.

Cadmium salts, zinc salts, thallium salts, iridium salts or complex salts thereof, rhodium salts or complex salts thereof, or iron salts or complex salts thereof, for example, may be present during the formation or physical ripening processes of the silver halide grains used in the present invention.

Gelatin is useful as a binding agent or protective colloid which can be used in emulsion layers or intermediate layers of the light-sensitive materials of the present invention, but other hydophilic colloids can be used for this purpose. For example, gelatin derivatives, graft polymers of other polymers with gelatin, proteins such as albumin and casein, cellulose derivatives such as hydroxyethylcellulose, carboxymethylcellulose and cellulose sulfate esters, sodium alginate, sugar derivatives such as starch derivatives, and various synthetic hydrophilic polymeric materials (for example homopolymers or copolymers such as poly(vinyl alcohol), partially acetalated poly(vinyl alcohol), poly(N-vinylpyrrolidone), poly(acrylic acid), poly(methacrylic acid), polyacrylamide, polyvinylimidazole and polyvinylpyrazole) can be used for this purpose.

As well as general purpose lime-treated gelatins, acid-treated gelatins and enzyme-treated gelatins, as disclosed in *Bull. Soc. Sci. Phot. Japan*, No. 16, page 30 (1966), can be used for the gelatin, and gelatin hydrolyzates can also be used.

Light-sensitive materials of the present invention may contain inorganic or organic hardening agents in any of the hydrophilic colloid layers which form photographic light-sensitive layers or backing layers. Chromium salts, aldehydes (for example, formaldehyde, glyoxal, glutaraldehyde) and N-methylol compounds (for example, dimethylolurea) are examples of such compounds. The use of active halogen compounds (for example, 2,4-dichloro-6-hydroxy-1,3,5-triazine and its sodium salt), and active vinyl compounds (for example, 1,3-bis-vinylsulfonyl-2-propanol, 1,2-bis(vinylsulfonylacetamido)ethane, bis(vinylsulfonylmethyl) ether or vinyl based polymers which have vinyl groups in side chains) is preferred for rapidly hardening the hydrophilic colloids such as gelatin, thus providing stable photographic characteristics. N-Carbamoylpyridinium salts (for example, (1-morpholinocarbonyl-3-pyridino)methanesulfonate), and haloamidinium salts (for example, 1-(1-chloro-1-pyridinomethylene)pyrrolidinium-2-naphthalenesulfonate) are also excellent for providing rapid hardening rates.

Silver halide photographic emulsions used in the present invention may be spectrally sensitized using methine dyes or by other known means. Dyes which can thus be used include cyanine dyes, merocyanine dyes, complex cyanine dyes, complex merocyanine dyes, holopolar cyanine dyes, hemi-cyanine dyes, styryl dyes and hemi-oxonol dyes. Dyes classified as cyanine dyes, merocyanine dyes and complex merocyanine dye are preferred.

All of the nuclei generally used in cyanine dyes can be used for basic heterocyclic nuclei in these dyes, mentioned above, for spectral sensitization. For example, the nucleus may be a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus or a pyridine nucleus; a nucleus in which one of these nuclei is fused with an alicyclic hydrocarbyl ring, or nucleus in which one of these nuclei is fused with an aromatic hydrocarbyl ring, for example, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus. These nuclei may be substituted at the carbon atoms.

A nucleus, which has a ketomethylene structure in merocyanine dyes or complex merocyanine dyes, may be a five or six membered heterocyclic nucleus, for example, a pyrazolin-5-one nucleus, a thiohydantoin nucleus, a 2-thio-oxazolidin-2,4-dione nucleus, a thiazolidin-2,4-dione nucleus, a rhodanine nucleus or a thiobarbituric acid nucleus.

These sensitizing dyes may be used individually or in combination, and combinations of such sensitizing dyes may be used to achieve supersensitization. Substances which provide for supersensitization, being dyes with substantially no spectrally sensitizing action or substances which do not substantially absorb visible light, can be included in emulsions together with sensitizing dyes. For example, substituted aminostilbene compounds with a nitrogen containing heterocyclic group (for example, those disclosed in U.S. Pat. Nos. 2,933,390 and 3,635,721), aromatic organic acid/formaldehyde condensates (for example, those disclosed in U.S. Pat. No. 3,743,510), and cadmium salts and azaindene compounds, for example, may be included. Such combinations disclosed in U.S. Pat. Nos. 3,615,613, 3,615,641, 3,617,295 and 3,635,721 are especially useful.

Various compounds can be included in silver halide photographic emulsions of the present invention in order, e.g., to prevent fogging during manufacture, storage or photographic processing of the light-sensitive material, or stabilize photographic performance. Thus, many compounds which are known as anti-fogging agents or stabilizers, can be added to emulsions of the present invention, for example, azoles (for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles), mercaptotetrazoles (especially 1-phenyl-5-mercaptotetrazole); mercaptopyrimidines; mercaptotriazines; thioketo compounds such as oxazolinethione; azaindenes (for example, triazaindenes, tetra-azaindenes [especially 4-hydroxy substituted (1,3,3a,7)-tetra-azaindenes] and penta-azaindenes); benzenethiosulfonic acid; benzenesulfinic acid; and benzenesulfonic acid amide, can be added for this purpose.

One or more types of surfactants may be included in light-sensitive materials of the present invention for various purposes, for example, as coating aids, antistatic agents, for improving slip properties, for emulsification and dispersion purposes, for preventing adhesion or for improving photographic characteristics (for example, for accelerating development, increasing contrast or increasing sensitivity).

Light-sensitive materials of the present invention may contain water soluble dyes (in hydrophilic colloid layers) as filter dyes, for the prevention of irradiation or halation, or for various other purposes. Oxonol dyes, hemi-oxonol dyes, styryl dyes, merocyanine dyes, anthraquinone dyes, and azo dyes are preferably used as dyes of this type, but cyanine dyes, azomethine dyes, triarylmethane dyes and phthalocyanine dyes are also useful. Oil soluble dyes can be emulsified using oil in water dispersion methods and added to hydrophilic colloid layers.

The present invention can be applied to multi-layer multi-color photographic materials which have layers of at least two different spectral sensitivities on a support. Multi-layer natural color photographic materials generally have, on a support, at least one red sensitive emulsion layer, at least one green sensitive emulsion layer and at least one blue sensitive emulsion layer. The order of these layers can be changed arbitrarily, as required. Preferred layer arrangements are (beginning with the layer closest to the support) red-sensitive layer, green-sensitive layer, blue-sensitive layer; blue-sensitive layer, green-sensitive layer, red-sensitive layer or, from the support side, blue-sensitive layer, red-sensitive layer, green-sensitive layer. Furthermore, any emulsion layers of the same color sensitivity may be comprised of two or more emulsion layers which have different photographic sensitivity to improve the sensitivity achieved, and graininess of the developed film can be reduced by using triple layer structures. Furthermore, light-insensitive layers may be present between two or more emulsion layers which have the same color sensitivity. Structures in which an emulsion layer having a different color sensitivity is introduced between certain emulsion layers which have the same color sensitivity can also be used. The establishment of a reflecting layer, such as a fine grained silver halide layer, below the highest sensitivity layer, and especially below the highest sensitivity blue-sensitive layer, may be used to increase photographic sensitivity.

Cyan forming couplers can be generally included in red-sensitive emulsion layers, magenta forming couplers can be generally included in green-sensitive emulsion layers, and yellow forming couplers can be generally included in blue-sensitive emulsion layers, but different combinations can be used, depending on the desired results. For example, with the incorporation of an infrared-sensitive layer, the materials can be used for making false color photographs or for use with semiconductor laser exposures.

Photographic emulsion layers and other layers in the photographic materials of the present invention can be coated onto a flexible support (such as, a plastic film, paper or cloth) or onto a rigid support (such as glass, porcelain or metal) of types generally used for photographic light-sensitive materials. Useful flexible supports include, for example, films made of semi-synthetic or synthetic polymers (for example, cellulose nitrate, cellulose acetate, cellulose acetate butyrate, polystyrene, poly(vinyl chloride), poly(ethylene terephthalate) or polycarbonate) and papers which have been coated or laminated with a baryta layer or an $\alpha$-olefin polymer (for example, polyethylene, polypropylene, ethylene/butene copolymer). The support may be colored using dyes or pigments. The support may also be colored black for light shielding purposes. The surface of the support can be generally undercoated in order, e.g., to improve adhesion with the photographic emulsion layer. The surface of the support may be subjected, e.g., to glow discharge treatment, corona discharge treatment, ultraviolet irradiation or a flame treatment, before or after undercoating treatment.

Coating of photographic emulsion layers and other hydrophilic colloid layers used in the present invention can be achieved using a variety of known coating methods, for example using dip coating, roller coating, curtain coating, or extrusion coating methods. Multi-layers can be coated simultaneously using methods disclosed, for example, in U.S. Pat. Nos. 2,681,294, 2,761,791, 3,526,528 and 3,508,947, as required.

The present invention can be applied to various color, and black-and-white light-sensitive materials. Typical applications include color negative films (for general and cinematographic purposes), color reversal films (for slides and television purposes), color pages, color positive films and color reversal papers, color diffusion transfer type light-sensitive materials, and heat-developable type color light-sensitive materials. The present invention can also be applied to black-and-white light-sensitive materials, intended for X-ray purposes, in which the mixtures of three color couplers are used (e.g., as disclosed, for example, in *Research Disclosure,* No. 17123 [published July 1978]) or in which black colored couplers are used (e.g., as disclosed, for example, in U.S. Pat. No. 4,126,461 and British Patent 2,102,136). The present invention can also be applied to printing plate making films (such as lith films and scanner films); X-ray films (intended for use, e.g., in direct or indirect medical or industrial applications), camera black-and-white negative films, black-and-white printing papers, microfilms for COM or general purposes, and print-out type light-sensitive materials.

Various exposure means can be used with light-sensitive materials of the present invention. Any light source which emits radiation with a band width corresponding to sensitive wavelengths of light-sensitive materials can be used as an exposing light source or write-in light source. For example, natural light (sunlight), incandescent electric lamps, sealed halogen lamps, mercury lamps, fluorescent lamps or flash lamps (such as strobes and burning metal flash lamps), can be used in general. Additionally, gas, dye solution or semiconductor lasers (which emit light in wavelength regions from the ultraviolet region through to the infrared region), light emitting diodes, and plasma light sources, can also be used as light sources for recording purposes. Furthermore, exposing devices such as fluorescent screens which release light from phosphors which have been excited by an electron beam (e.g., a CRT) or one in which a line type or surface type light source is combined with a micro-shutter array (such as a liquid crystal display (LCD) or a lead titanium zirconate doped with lanthanum (PLZT) device), can also be used. Spectral distributions of light which is used to make exposures can be adjusted, as required, using color filters.

Color developers used for development processing of light-sensitive materials of the present invention are preferably aqueous alkaline solutions preferably having pH of 10 to 12 which contain primary aromatic amine-based color developing agents as the principal component. Aminophenol based compounds are also useful, but the use of p-phenylenediamine based compounds as color developing agents is preferred. Typical examples of these compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and the sulfate, hydrochloride and p-toluenesulfonate salts, for example, of these compounds. These diamines are generally more stable in the form of salts than in their free state, and the use of the salts is preferred.

Moreover, pH buffers, such as alkali metal carbonates, borates or phosphates, and development inhibitors or anti-foggants (such as bromide, iodide, benzimidazoles, benzothiazoles or mercapto compounds) can be generally included in color developers used with the present invention. Preservatives (such as hydroxylamine or sulfite), organic solvents (such as triethanolamine and diethylene glycol), development accelerators (such as benzyl alcohol, polyethylene glycol), quaternary ammonium salts and amines, dye forming couplers, competitive couplers, nucleating agents (such as sodium borohydride), auxiliary developing agents (such as 1-phenyl-3-pyrazolidone), viscosity imparting agents, various chelating agents (such as aminopolycarboxylic acids, aminopolyphosphonic acids, alkylphosphonic acids and phosphonocarboxylic acids), and antioxidants (e.g., as disclosed in West German Patent Application (OLS) 2,622,950) may be added, as required, to color developers.

Color development of photographic materials of the present invention is carried out after normal black-and-white development in the development processing of reversal color light-sensitive materials. Known black-and-white developing agents (for example, dihydroxybenzenes [such as hydroquinone], 3-pyrazolidones [such as 1-phenyl-3-pyrazolidone], or aminophenols [such as N-methyl-p-aminophenol]) can be used individually or in combinations in black-and-white developers.

Color developed photographic emulsion layers are normally subjected to bleaching processes. Bleaching processes can be carried out at the same time as fixing processes, or may be carried out separately. Moreover, a method of processing in which bleach-fixing is carried out after a bleaching process can be used in order to speed up processing. Compounds of multi-valent metals (such as iron(III), cobalt(III), chromium(IV) and copper(II)), peracids, quinones, and nitron compounds, for example, can be used as bleaching agents. Thus, ferricyanides; dichromates; organic complex salts of iron(III) or cobalt(III) (for example, complex salts with aminopolycarboxylic acids [such as ethylenediamine tetra-acetic acid, diethylenetriamine penta-acetic acid, nitrilotriacetic acid, and 1,3-diamino-2-propanol tetra-acetic acid] or organic acids [such as citric acid, tartaric acid or malic acid]); persulfates; manganates; and nitrosophenol can be used as bleaching agents. Of these, the use of ethylenediamine tetraacetic acid iron(III) salts, diethylenetriamine pentaacetic acid iron(III) salts and persulfate, is preferred for rapid processing and for minimizing environmental pollution. Moreover, ethylenediamine tetra-acetic acid iron(III) complex salts are especially useful in both independent bleach baths and single bath bleach-fix baths. The pH of bleach bath is preferably from 2 to 8.

Bleaching accelerators can be used, as required, in bleach baths, bleach-fix baths and bleach or bleachfix pre-baths used for developing materials of the present invention. Examples of useful bleach accelerators have been disclosed in the following specifications; compounds which have a mercapto group or a disulfide group (as disclosed, for example, in U.S. Pat. No. 3,893,858, West German Patents 1,290,812 and 2,059,988, JP-A-53-32736, JP-A-53-57831, JP-A-53-37148, JP-A-53-65732, JP-A-53-72623, JP-A-53-95630, JP-A-53-95631, JP-A-53-10432, JP-A-53-124424, JP-A-53-141623, JP-A-53-28426, and *Research Disclosure,* No. 17129 [July, 1978]); thiazolidine derivatives (e.g., as disclosed in JP-A-50-140129); thiourea derivatives (e.g., as disclosed in JP-B-45-8506, JP-A-52-20832, JP-A-53-32735 and U.S. Pat. No. 3,706,561); iodide (e.g., as disclosed in West German Patent 1,127,715 and JP-A-58-16235); polyethylene oxides (e.g., as disclosed in West German Patents 966,410 and 2,748,430); polyamine compounds (e.g., as disclosed in JP-B-45-8836); other suitable bleaching accelerators (e.g., as disclosed in JP-A-49-42434, JP-A-49-59644, JP-A-53-94927, JP-A-54-35727, JP-A-55-26506 and JP-A-58-163940); and iodine and bromine ions. From among these compounds, those which have a mercapto group or a disulfide group are preferred due to their significant accelerating effect. Such bleach accelerating compounds disclosed, e.g., in U.S. Pat. No. 3,893,858, West German Patent 1,290,812 and JP-A-53-95630 are especially preferred, as are accelerating compounds disclosed in U.S. Pat. No. 4,552,834. Such bleach accelerators may also be included in light-sensitive materials, and are especially effective when bleach-fixing color light-sensitive materials used in cameras.

Thiosulfate, thiocyanate, thioether based compounds, thioureas and large amounts of iodide can be used, for example, as fixing agents, but thiosulfates are preferred. The pH of fixer bath is preferably from 4 to 8. Sulfites, bisulfites, or carbonyl/bisulfite addition compounds are preferred as examples of preservatives for bleach-fix baths and fixer baths.

A water washing process and a stabilization process are generally carried out after the bleach-fixing process or fixing process. Various known compounds can be added to the solutions used in water washing and stabilizing processes to prevent sedimentation and also to economize water usage. For example, hard water softening agents (such as inorganic phosphoric acid, aminopolycarboxylic acids, organic aminopolyphosphonic acid and organic phosphoric acids); disinfectants and biocides (for preventing the growth of various bacteria, algae and fungi); and metal salts (as typified by magnesium salts, aluminum salts and bismuth salts) can be added, as required, to prevent the occurrence of precipitation, growth of organisms and sedimentation. Surfactants and various hardening agent can also be added, as required, to reduce the drying load and to prevent unevenness. Alternatively, compounds disclosed, e.g., by L. E. West in *Phot. Sci Eng.*, Vol. 6, pages 344 to 359 (1965) may be added. The addition of chelating agents and biocides is especially preferred.

Counter-current washing with two or more tanks can be generally employed in water washing processes to economize on water. Moreover, a multi-stage counter-current stabilization process (such as that disclosed, e.g., in JP-A-57-8543) can be used in place of water washing processes. In this case, a counter-current system which has from two to nine tanks is required. Various compounds for image stabilization may be added to the stabilizing bath, in addition to the aforementioned additives. For example, various buffers can be used to control pH (e.g., from about 3 to 9), for example, combinations of borates, metaborates, borax, phosphates, carbonates, potassium hydroxide, sodium hydroxide, aqueous ammonia, monocarboxylic acids, dicarboxylic acids, and polycarboxylic acids, and aldehydes (such as formalin). Furthermore, various other additives can be used, as required, such as chelating agents (for example, inorganic phosphoric acid, aminopolycarboxylic acids, organophosphonic acids, organophosphonic acids, aminopolyphosphonic acids and phosphonocarboxylic acids), disinfectants (for example, benzoisothiazolinone, isothiazolone, 4-thiazolinbenzimidazole, halogenated phenols, sulfanilamide and benzotriazole), surfactants, brightening agents and hardening agents. Two or more types of compounds can also be used in combination for the same or different purposes.

Furthermore, various ammonium salts, such as ammonium chloride, ammonium nitrate, ammonium sulfate, ammonium phosphate, ammonium sulfite and ammonium thiosulfate, are preferably added as post-processing adjusting agents for film pH.

Furthermore, post fixing (water washing - stabilization) processes, which can be generally used with camera color light-sensitive materials, can also be replaced with the aforementioned stabilization processes and water washing processes (processing reduced water usage). When a two-equivalent magenta coupler is involved in such cases, it is preferred that formalin should be removed from the stabilizing bath.

Water washing and stabilization processing times used in the present invention differ according to the type of light-sensitive materials and processing conditions, but the time is preferably in the range of about 20 seconds to about 10 minutes, and more preferably in the range from about 20 seconds to about 5 minutes.

Color developing agents can be incorporated into a silver halide color light-sensitive material of the present invention to simplify and speed up processing. The incorporation of various color developing agent precursors is preferred. For example, indoaniline based compounds (as disclosed, e.g., in U.S. Pat. No. 3,342,597); Schiff's base type compounds (e.g., as disclosed in U.S. Pat. No. 3,342,599 and *Research Disclosure,* No. 14850, and ibid, No. 15159); aldol compounds (e.g., as disclosed in *Research Disclosure,* No. 13924); metal complex salts (e.g., as disclosed in U.S. Pat. No. 3,719,492); and urethane based compounds (e.g., as disclosed in JP-A-53-135628), and also various salt type precursors (e.g., as disclosed in JP-A-56-6235, JP-A-56-16133, JP-A-56-59232, JP-A-56-67842, JP-A-56-83734, JP-A-56-83735, JP-A-56-83736, JP-A-56-89735, JP-A-56-81837, JP-A-56-54430, JP-A-56-106241, JP-A-56-107236, JP-A-57-97531 and JP-A-57-83565) can be used for this purpose.

Various 1-phenyl-3-pyrazolidones can be incorporated, as required, into silver halide color light-sensitive materials of the present invention to accelerate color development. Typical examples of such compounds have been disclosed, for example, in JP-A-56-64339, JP-A-57-144547, JP-A-57-211147, JP-A-58-50532, JP-A-58-50536, JP-A-58-50533, JP-A-58-50534, JP-A-58-50535 and JP-A-58-115438.

Various processing baths used in the present invention can be preferably maintained at a temperature of from about 10° C. to 50° C. The temperature can be generally from about 33° C. to 38° C., but accelerated processing and shorter processing times can be realized at higher temperatures while increased picture quality and improved processing bath stability can be achieved at lower temperatures. Furthermore, processes using cobalt intensification or hydrogen peroxide intensification, (e.g., as disclosed in West German Patent 2,226,770 or U.S. Pat. No. 3,674,499), can be used in order to economize on the amount of silver used in light-sensitive materials of the present invention.

Heaters, temperature sensors, liquid level sensors, circulating pumps, filters, floating lids and squeegees and other desired processing equipment may be provided, as required, in each of the various processing baths used for developing photographic materials of the present invention.

Furthermore, replenishers can be used for various processing baths when continuous processing is being carried out, and a constant level of development can be obtained by preventing fluctuation in bath composition in this way. Replenishment can be made at half, or less than half, the standard replenishment rate in order to reduce costs.

Bleach-fix processes can be used when light-sensitive material of the present invention is a color paper, and such bleach-fix processes can be used as required in the case of camera color photographic materials.

Dyes in a dye layer of silver halide photographic light-sensitive materials of the present invention have the appropriate spectral absorbances, dye the dye layer specifically, and do not diffuse into other layers of the photographic material, resulting in superior quality developed photographic material.

Silver halide photographic light-sensitive materials of the present invention which contain compounds that are decolorized or washed out easily by photographic processing provide the effect that a low $D_{min}$ is obtained without loss of photographic sensitivity, and decrease in photographic sensitivity on storage is minimized.

Moreover, the silver halide photographic light-sensitive materials of the present invention provide images which have increased sharpness. Furthermore, photographs obtained from silver halide photographic light-sensitive materials of the present invention are resistant to staining and exhibit no loss of photographic performance, due to retention of stability even during long term storage.

The present invention is described in detail below by means of the following examples. The following abbreviations are used in the following examples.

UV: Ultraviolet absorber, solv: High boiling point organic solvent, ExF: Dye, ExS: Sensitizing dye, ExC: Cyan coupler, ExM: Magenta coupler, ExY: Yellow coupler, Cpd: Additive.

EXAMPLE 1

Preparation of Emulsion A

An aqueous solution of silver nitrate and an aqueous solution of sodium chloride which contained $0.5\times10^{-4}$ mol/mol.Ag of ammonium hexachlororhodium(III) were mixed using a controlled double jet method in a gelatin solution at 35° C. with a control in such a way that the pH was 6.5 and a monodisperse silver chloride emulsion of average grain size 0.07 μm was obtained.

After forming the grains, the soluble salts were removed using the known flocculation method, with 4-hydroxy-6-methyl-1,3,3a,7-tetra-azaindene and 1-phenyl-5-mercaptotetrazole added as stabilizers. The gelatin content and silver content, per kilogram of emulsion, were 55 grams and 105 grams respectively. (Emulsion A)

Preparation of Light-sensitive Material

The nucleating agents and nucleation accelerators, indicated below, were added to the aforementioned emulsion A, and then 300 mg/m² of poly(ethyl acrylate) latex and 2,4-dichloro-6-hydroxy-1,3,5-triazine sodium salt (as a hardening agent) were added and a silver halide emulsion layer was coated on a transparent poly(ethylene terephthalate) support in such a way as to provide a coated silver weight of 3.5 grams per square meter.

| Nucleating Agent | Amount Added (mg/m²) |
|---|---|
| 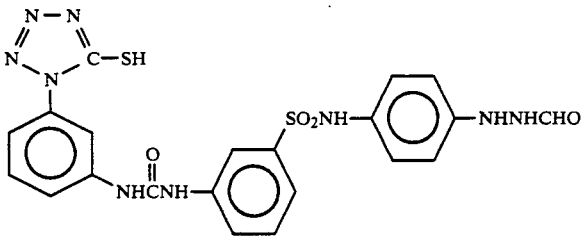 | 11.8 |
| 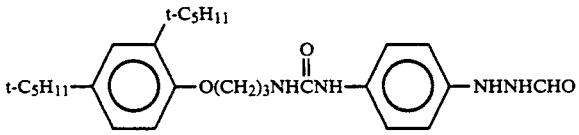 | 9.3 |
| 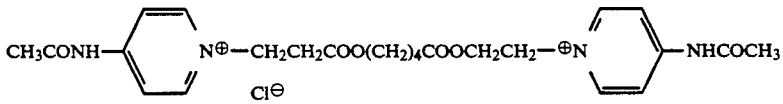 | 28.0 |
| 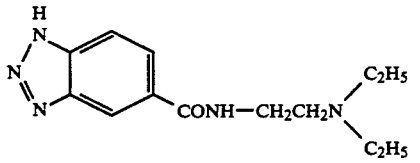 | 60.0 |

A protective layer which contained 1.3 g/m² of gelatin, 0.1 g/m² of Compound 8 of the present invention, three surfactants indicated below as coating promotors) and the stabilizer and matting agent indicated below were coated over the aforementioned layer and dried. (Sample 1)

| | Amount Added (mg/m²) |
|---|---|
| Surfactants | |
| 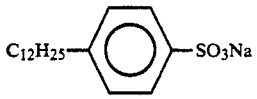 | 37 |
| $CH_2COOC_6H_{13}$<br>\|<br>$CHCOOC_6H_{13}$<br>\|<br>$SO_3Na$ | 37 |
| $C_8F_{17}SO_2NCH_2COOK$<br>\|<br>$C_3H_7$ | 2.5 |
| Stabilizer<br>Thioctic acid | 6.0 |
| Matting Agent<br>poly(methyl methacrylate)<br>(Average grain size 2.5 μm) | 9.0 |

Moreover, a dispersion of Compound 8 of the present invention was prepared and included in Example 1, as indicated below.

Preparation of the Dye Dispersion

Liquid I

| | |
|---|---|
| Dye (Compound 8 of the present invention) | 26 grams |
| Dimethylformamide | 53 ml |
| Citric acid | 0.1 gram |

Liquid II

| | |
|---|---|
| Gelatin | 60 grams |
| $H_2O$ | 830 ml |
| Phenol (10%) | 12 ml |
| $C_{11}H_{23}CONH(CH_2)_3N^{\oplus}(CH_3)_2(CH_2)_4SO_3^{\ominus}$ | 17 grams |

Liquid I was added gradually while stirring liquid II at 40° C.

Preparation of Comparative Samples

1) A comparative sample (Comparative Sample 1-A) was prepared using the dye indicated below in place of Compound 8 in Example 1.

Dye

-continued

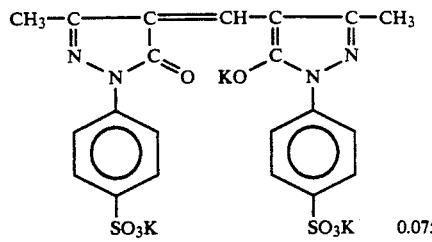

0.075 g/m²

2) A second comparative sample (Comparative Sample 1-B) was prepared using the dye indicated below, in place of Compound 8 in Example 1.

This dye is disclosed, e.g., in PCT Published Patent Application WO88/04794.

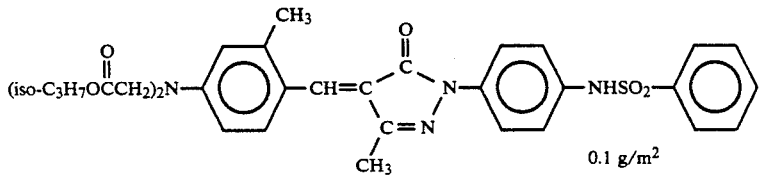

0.1 g/m²

3) A third comparative sample (Comparative Sample 1-C) was prepared using the protective layer indicated below instead of the protective layer which contained Compound 8 of the present invention of Example 1.

| | |
|---|---|
| Acid-Treated Gelatin | 2.0 g/m² |
| Mordant | 1.0 g/m² |
| 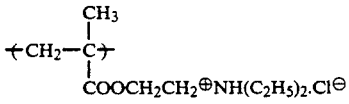 | |
| Dye | 0.75 g/m² |
| 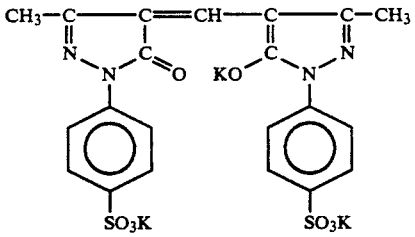 | |
| Surfactants | |
| $C_{11}H_{23}CONH(CH_2)_3N^{\oplus}(CH_3)_2(CH_2)_4SO_3^{\ominus}$ | 0.53 g/m² |
| $CH_2COOC_6H_{13}$<br>\|<br>$CHCOOC_6H_{13}$<br>\|<br>$SO_3Na$ | 0.037 |
| $C_8F_{17}SO_2NCH_2COOK$<br>\|<br>$C_3H_7$ | 0.0025 |
| Stabilizer<br>Thiotic acid | 0.006 |
| Matting Agent<br>poly(methyl methacrylate)<br>(Average particle size 2.5 μm) | 0.009 |

Evaluation of Performance (1) The four samples described above were exposed through an optical wedge using a light-room printer (model P-607, available from Dainippon Screen Co.), developed for 20 seconds at 38° C. using the following developer and fixed in the usual way (pH: 4~8) and then washed with water and dried.

Basic Developer Formulation

| | |
|---|---|
| Hydroquinone | 35.0 grams |
| N-Methyl-p-aminophenol hemi-sulfate | 0.8 gram |
| Sodium hydroxide | 13.0 grams |
| Potassium triphosphate | 74.0 grams |
| Potassium sulfite | 90.0 grams |
| Sodium ethylenediaminetetraacetate | 1.0 gram |
| Potassium bromide | 4.0 gram |
| 5-Methylbenzotriazole | 0.6 gram |
| 3-Diethylamino-1,2-propanediol | 15.0 grams |
| Water to make up to | 1 liter |
| | (pH = 11.5) |

The results obtained showed that Sample 1 and Comparative Sample 1-A were completely decolorized, but Comparative Samples 1-B and 1-C showed residual yellow staining. Comparative Sample 1-B was completely decolorized when the development time was increased to 30 seconds. As indicated above, the compound of the present invention underwent rapid decolorization.

(2) Tone Variability Test

The four samples (Sample 1 and Comparative Samples 1-A, 1-B and 1-C) were exposed through a flat halftone screen using the printer mentioned above and then were developed and processed as described in (1) above.

The exposure times were determined in such a way that the halftone dot areas for each sample were 1 : 1 and the samples were then exposed with two and four times this exposure to determine whether or not there was an increase in halftone dot area. Samples showed excellent tone variability over a wide range. The results obtained are shown in Table 1, which demonstrate that while there was a pronounced reduction in tone variability with Comparative Sample 1-A, Sample 1 of the present invention had a high tone variability. This is because the dye used in Comparative Sample 1-A is water soluble and diffusible and diffuses uniformly from the layer to which it had been added into the photographic emulsion layer, suppressing the increase in the halftone dot area as a result of the dye's anti-irradiation effect on increased the exposure time. In contrast, Compound 8 of the present invention in Example 1 was fixed in the layer to which it had been added, so that this sample exhibited high degree of tone variability.

Comparative Samples 1-B and 1-C exhibited good tone variability.

TABLE 1

Tone Variability (showing Increase in Halftone Dot areas)

| | Double Exposure | Quadruple Exposure |
|---|---|---|
| Comp. Sample 1-A | +3% | +5% |
| Comp. Sample 1-B | +6% | +10% |
| Comp. Sample 1-C | +5% | +8% |
| Invention, Sample 1 | +6% | +10% |

(3) Evaluation of Staining due to Reducer

Strips of Sample 1 of the present invention and of the Comparative Samples, obtained by processing in (2) above, were immersed in Farmer's Reducer, as indicated below, for a period of 60 seconds at 20° C. and then washed with water and dried. The results showed that, with all the samples, the 50% halftone dot area could be reduced to about 33%, but with Comparative Sample 1-C there was severe brown staining over the whole area. No staining was observed with Sample 1 of the present invention or with Comparative Samples 1-A and 1-B.

Farmers Reducer

Liquid 1

| | |
|---|---|
| Water | 200 ml |
| Sodium thiosulfate | 20 grams |

Liquid 2

| | |
|---|---|
| Water | 100 ml |
| Potassium ferricyanide | 10 grams |

For use, Liquid 1, Liquid 2 and water were mixed in the proportions of 100 parts to 5 parts to 100 parts, respectively.

As described above, the sample of the present invention was good in terms of decolorizing properties, tone variability and reduction properties.

EXAMPLE 2

Compound 9, and Compound 12, were used in place of Compound 8 in Example 1.

As in Example 1, the results for Example 2 indicated good decolorizing properties, good tone variability and good reducing properties, as compared to Comparative Samples 1-A, 1-B and 1-C.

EXAMPLE 3

A fine crystal dispersion prepared in the same way as described in the aforementioned examples was coated as a dye layer, with the emulsion and the surface protective layer, all as indicated below, on both sides of an undercoated poly(ethylene terephthalate) film which had been dyed blue of thickness 175 μm to provide photographic material Control Sample 3-1, Comparative Samples 3-2 and 3-3 and, Samples 3-4 to 3-6 as shown in Table 2, below.

Dye Layer Content—per side

| | |
|---|---|
| Gelatin | 0.12 g/m$^2$ |
| Fine dye crystal dispersion | See TABLE 2 |

Emulsion Layer Details

Preparation of the Emulsion Layer Coating Liquid

Potassium bromide (5 grams), 0.05 gram of potassium iodide, 30 grams of gelatin and 2.5 cc of a 5% aqueous solution of the thioether $HO(CH_2)_2S(CH_2)_2S(CH_2)_2OH$ were added to 1 liter of water and an aqueous solution containing 8.33 grams of silver nitrate and an aqueous solution containing 5.98 grams of potassium bromide and 0.726 gram of potassium iodide were added over a period of 45 seconds using the double jet method while stirring the mixture and maintaining a temperature of 75° C. Next, after adding 2.5 grams of potassium bromide, an aqueous solution which contained 8.33 grams of silver nitrate was added over a period of 7 minutes 30 seconds in such a way that the flow rate at the end of the addition was twice that at the start of the addition. Next, an aqueous solution containing 153.34 grams of silver nitrate and an aqueous solution of potassium bromide were added over a period of 25 minutes using the controlled double jet method in such a way that the potential was maintained at pAg 8.1. The flow rate at this time was increased in such a way that the flow rate at the end of the addition was eight times that at the start of the addition. After the addition had been completed, 15 cc of 2N potassium thiocyanate solution was added and 50 cc of a 1% aqueous potassium iodide solution was added over a period of 30 seconds. Subsequently, the temperature was reduced to 35° C. and, after removing the soluble salts by flocculation method, the temperature was raised to 40° C., 68 grams of gelatin, 2 grams of phenol and 7.5 grams of trimethylolpropane were added, and the emulsion was adjusted to pH 6.55, pAg 8.10, using sodium hydroxide and potassium bromide.

The sensitizing dye (735 mg), as indicated below, was added after raising the temperature to 56° C. After 10 minutes, 5.5 mg of sodium thiosulfate pentahydrate, 163 mg of potassium thiocyanate and 3.6 mg of chloroauric acid were added and the mixture was cooled rapidly and solidified after 5 minutes. The emulsion obtained was such that 93% of the total projected area of all the grains was accounted for by grains of which the aspect ratio was at least 3, and of all the grains of aspect ratio at least 2 the average projected area diameter was 0.83 μm, the standard deviation was 18.5%, the average thickness was 0.161 μm and the aspect ratio was 5.16.

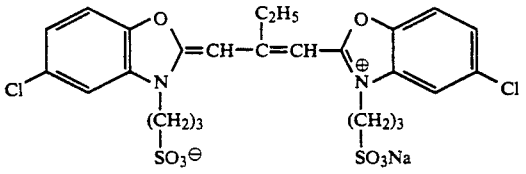

The following reagents were added per mol of silver halide to this emulsion to provide a coating liquid.

| | |
|---|---|
| 2,6-Bis(hydroxyamino)-4-diethylamino-1,3,5-triazine | 94.5 mg |
| Poly(sodium acrylate) (average molecular weight 41,000) | 2.7 grams |
| 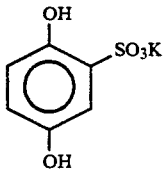 | 10.0 grams |
| Ethyl acrylate/acrylic acid/methacrylic acid copolymer plasticizer of composition ratio 95/2/3 | 24.8 grams |

-continued

| | |
|---|---|
| Potassium bromide | 77 mg |

Coated Weights of Emulsion Layer, per side

| | |
|---|---|
| Coated silver weight | 1.7 g/m$^2$ |
| Coated gelatin weight | 1.7 g/m$^2$ |
| Polyacrylamide (average molecular weight 45,000) | 0.47 g/m$^2$ |

Surface Protecting Layer Content

The coated weights of the surface protective layer are indicated, per side, below.

| | |
|---|---|
| Gelatin | 1.4 g/m$^2$ |
| Polyacrylamide (average molecular weight 45,000) | 0.23 g/m$^2$ |
| Matting agent (average particle diameter 3.5 μm) poly(methylmethacrylate/methacrylic acid = 9:1) copolymer | 0.05 g/m$^2$ |
| 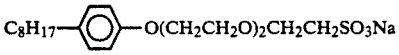 | 22.5 g/m$^2$ |
| $C_{16}H_{33}O(CH_2CH_2O)_{10}H$ | 20 mg/m$^2$ |
| $C_8H_{17}SO_2N(C_3H_7)(CH_2CH_2O)_{15}H$ | 5 mg/m$^2$ |
| $C_8H_{17}SO_2N(C_3H_7)(CH_2CH_2O)_4(CH_2)_4SO_3Na$ | 1 mg/m$^2$ |
| 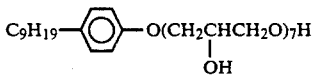 | 10 g/m$^2$ |
| 4-Hydroxy-6-methyl-1,3,3a,7-tetra-azaindene | 21.7 mg/m$^2$ |

1,2-Bis(sulfonylacetamido)ethane was coated as a hardening agent in an amount of 57 mg/m$^2$ per side.

Evaluation of Photographic Performance

A G-4 Grenex series screen (available from Fuji Photographic film Co.) was used as a screen for exposing the photographic material samples (Control Sample 3-1, Comparative Samples 3-2 and 3-3, and Samples 3-4 to 3-6). The photographic material samples 3-1 to 3-6 were sandwiched between two G-4 screens in intimate contact with the screens in the usual way and subjected to an X-ray exposure through a 10 cm water phantom.

Processing after exposure was carried out at 35° C. using RD-III made by the Fuji Photographic Film Co. for the developer and Fuji F made by the same company for the fixer in an automatic processor FPM-4000 also made by the same company.

Photographic sensitivities were indicated as relative sensitivities taking the sensitivity of photographic material Sample 3-1 to be 100.

Measurement of Sharpness (MTF)

MTF values were measured using the combination of G4 screens and automatic processor processing described earlier. The measurements were made with a 30 μm×500 μm aperture, and the evaluation was made in a region of optical density 1.0 using the MTF value for a spatial frequency of 1.0 cycle/mm.

Evaluation of Residual Coloration

Moreover, unexposed samples of the aforementioned photographic materials were processed in the way described above and the level of residual coloration was assessed visually in terms of the categories indicated below, with intermediate categories of B and D.

A . . . Virtually no residual coloration to be seen.

C . . . Some residual coloration but felt to be of no concern in practice.

E . . . Considerable residual coloration and the coloration would undoubtedly be noticed in practice.

The results of the evaluations described above are shown in Table 2, along with the sample details.

It is clear from Table 2 that photographic material samples 3-4 to 3-6 of the present invention were superior in respect of the balance between relative sensitivity, sharpness (MTF) and residual coloration.

TABLE 2

| Photographic Material | Fine Crystal Dispersion: Dye | Content Per Side ($mg/m^2$) | Relative Sensitivity | MTF | Residual Coloration |
|---|---|---|---|---|---|
| 3-1 (Control) | — | — | 100 | 0.64 | A |
| 3-2 (Comp. Ex.) | Comp. Cpd. 1 | 80 | 81 | 0.67 | D |
| 3-3 (Comp. Ex.) | Comp. Cpd. 2 | 80 | 77 | 0.68 | C |
| 3-4 (Invention) | Cpd. 1 of the invention | 50 | 89 | 0.72 | B |
| 3-5 (Invention) | Cpd. 1 of the invention | 100 | 85 | 0.74 | B |
| 3-6 (Invention) | Cpd. 10 of the invention | 50 | 87 | 0.72 | B |

Comparative Compound 1

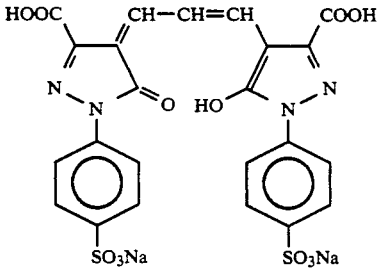

Comparative Compound 2

C.I. Acid Violet 19 (C.I. 42,685)

EXAMPLE 4

Paper support samples A, B and C were obtained using a gelatin under-layer or the dye dispersion indicated below after carrying out a corona discharge treatment on a paper support which had been laminated on both sides with polyethylene.

Method of Dispersing the Dye

Crystals of the dye indicated below were milled and finely pulverized in a sand mill. This was then dispersed in 25 ml of a 10% aqueous lime-treated gelatin solution in which 0.5 gram of citric acid had been dissolved and, after removing the sand with a glass filter, the dye which was attached to the sand on the glass filter was removed and 100 ml of a 7% gelatin solution was added (the average particle size of the fine dye particles was 0.15 μm)

| | |
|---|---|
| Compound 8 of this invention | 1.0 g |

-continued

| | |
|---|---|
| Compound 70 of this invention | 1.6 g |
| 5% aqueous solution of | 5 ml |

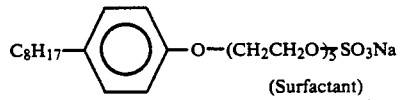

(Surfactant)

The following dispersion was also prepared.

| | |
|---|---|
| Compound 8 of this invention | 1.0 g |
| Compound III-3 of this invention | 1.6 g |

Paper Support A Under-layer

| | |
|---|---|
| Gelatin | 0.8 $g/m^2$ |

Paper Support B Anti-halation Layer

| | |
|---|---|
| Gelatin | 0.6 $g/m^2$ |
| Compound 8 of this invention | 25 $mg/m^2$ |
| Compound 70 of this invention | 40 $mg/m^2$ |

Paper Support C Anti-halation Layer

| | |
|---|---|
| Gelatin | 0.6 $g/m^2$ |
| Compound 8 of this invention | 40 $mg/m^2$ |
| Compound III-3 of this invention | 65 $mg/m^2$ |

Multi-layer color printing paper samples 4-1 to 4-4 of which the layer structure is indicated below were obtained on paper support Samples A, B and C.

The coating liquids were prepared as described below.

Preparation of the First Layer Coating Liquid

Ethyl acetate (27.2 cc) and 8.2 grams of solvent (Solv-1) were added to 19.1 grams of yellow coupler (ExY), 4.4 grams of color image stabilizer (Cpd-1) and 0.7 grams of color image stabilizer (Cpd-7) to form a solution which was then emulsified and dispersed in 185 cc of a 10% aqueous gelatin solution which contained 8 cc of 10% sodium dodecylbenzenesulfonate. In contrast, the blue-sensitive sensitizing dyes indicated below were added to a silver chlorobromide emulsion (a 3 : 7 (Ag mol ratio) mixture of cubic emulsions of average grain size 0.88 μm and 0.70 μm; the variation coefficients of the grain size distributions were 0.08 and 0.10, and each emulsion had 0.2 mol % silver bromide included locally on the surface of the grains) in amounts of $2.0\times10^{-4}$ mol of each per mol of silver for the emulsion which had large grains and in amounts of $2.5\times10^{31}$ 4 mol of each per mol of silver halide for the emulsion which had small grains, after which the emulsion was sulfur sensitized. This emulsion was mixed with the aforementioned emulsified dispersion to prepare the first layer coating liquid of which the composition is indicated below.

The coating liquids for the second to the seventh layers were prepared using the same procedure as for the first layer coating liquid. 1-Oxy-3,5-dichloro-s-triazine sodium salt, was used as a gelatin hardening agent in each layer.

The spectrally sensitizing dyes indicated below were used for each layer.

Blue-Sensitive Emulsion Layer

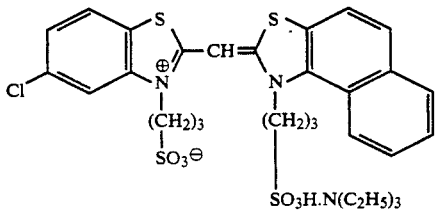

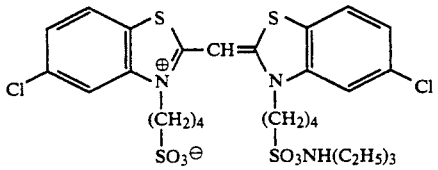

($2.0\times10^{-4}$ mol of each per mol of silver halide for the large size emulsion and $2.5\times10^{-4}$ mol of each per mol of silver halide for the small size emulsion)

Green-Sensitive Emulsion Layer

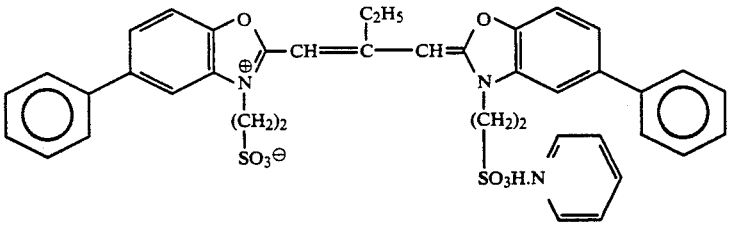

($4.0\times10^{-4}$ mol per mol of silver halide for the large size emulsion and $5.6\times10^{-4}$ mol per mol of silver halide for the small size emulsion) and

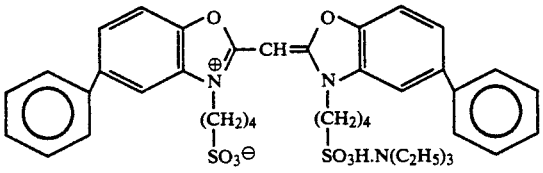

($7.0\times10^{-5}$ mol per mol of silver halide for the large size emulsion and $1.0\times10^{-5}$ mol per mol of silver halide for the small size emulsion)

Red-Sensitive Emulsion Layer

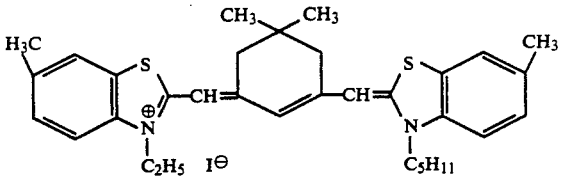

($0.9\times10^{-4}$ mol per mol of silver halide for the large size the small size emulsion)

The compound indicated below was added in an amount of $2.6\times10^{-3}$ mol per mol of silver halide to the red-sensitive emulsion layer.

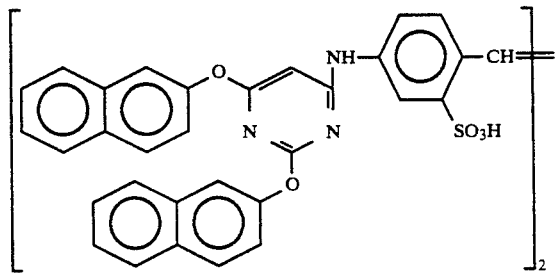

Furthermore, 1-(5-methylureidophenyl)-5-mercaptotetrazole was added to the blue, green and red-sensitive emulsion layers in amounts, per mol of silver halide of $8.5\times10^{-5}$ mol, $7.7\times10^{-4}$ mol and $2.5\times10^{-4}$ mol respectively.

Furthermore, 4-hydroxy-6-methyl-1,3,3a,7-tetraazaindene was added to the blue and green-sensitive emulsion layers in amounts, per mol of silver halide, of $1\times10^{-4}$ mol and $2\times10^{-4}$ mol respectively.

The comparative dyes indicated below were added to the emulsion layer on one of the paper support A samples.

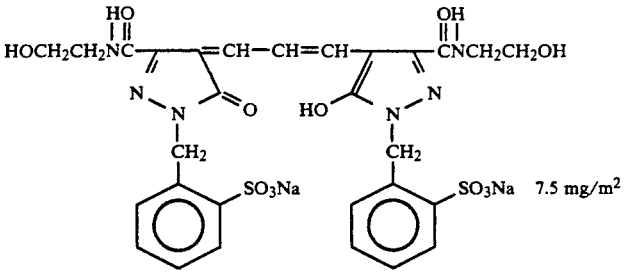

and

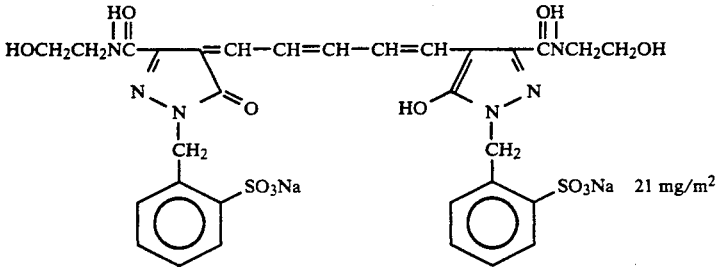

Layer Structure

The composition of each layer is indicated below. The numerical values indicate coated weights as g/m$^2$. In the case of silver halide emulsions the coated weight is shown as the calculated coated weight of silver.

Support

Four types, namely samples A, A, B and C which had an under-layer, anti-halation layer established on a polyethylene laminated paper [White pigment ($TiO_2$) and bluish dye (ultramarine) were included in the polyethylene on the first layer side]

First Layer (Blue-Sensitive Layer)

| | |
|---|---|
| The aforementioned silver chlorobromide emulsion | 0.30 |
| Gelatin | 1.86 |
| Yellow coupler (ExY) | 0.82 |
| Color image stabilizer (Cpd-1) | 0.19 |
| Solvent (Solv-1) | 0.35 |
| Color image stabilizer (Cpd-7) | 0.06 |

Second Layer (Color Stain Preventing Layer)

| | |
|---|---|
| Gelatin | 0.99 |
| Color stain preventing agent (Cpd-5) | 0.08 |
| Solvent (Solv-1) | 0.16 |
| Solvent (Solv-4) | 0.08 |

Third Layer (Green-Sensitive Layer)

| | |
|---|---|
| Silver chlorobromide emulsion (a 1:3 (silver mol ratio) mixture of a cubic emulsions of average grain size 0.55 μm and 0.39 μm; the variation coefficients of the grain size distributions were 0.10 and 0.08, and each emulsion had 0.8 mol% AgBr included locally on the grain surfaces) | 0.12 |
| Gelatin | 1.24 |

-continued

| | |
|---|---|
| Magenta coupler (ExM) | 0.20 |
| Color image stabilizer (Cpd-2) | 0.03 |
| Color image stabilizer (Cpd-3) | 0.15 |
| Color image stabilizer (Cpd-4) | 0.02 |
| Color image stabilizer (Cpd-9) | 0.02 |
| Solvent (Solv-2) | 0.40 |

Fourth Layer (Ultraviolet Absorbing Layer)

| | |
|---|---|
| Gelatin | 1.58 |
| Ultraviolet absorber (UV-1) | 0.47 |
| Color stain preventing agent (Cpd-5) | 0.05 |
| Solvent (Solv-5) | 0.24 |

Fifth Layer (Red-Sensitive Layer)

| | |
|---|---|
| Silver chlorobromide emulsion (a 1:4 (silver mol ratio) mixture of a cubic emulsions of average grain size 0.58 μm and 0.45 μm; the variation coefficients of the grain size distributions were 0.09 and 0.11, and each emulsion had 0.6 mol% AgBr included locally on the grain surfaces) | 0.23 |
| Gelatin | 1.34 |
| Cyan coupler (ExC) | 0.32 |
| Color image stabilizer (Cpd-6) | 0.17 |
| Color image stabilizer (Cpd-7) | 0.40 |
| Color image stabilizer (Cpd-8) | 0.04 |
| Solvent (Solv-6) | 0.15 |

Sixth Layer (Ultraviolet Absorbing Layer)

| | |
|---|---|
| Gelatin | 0.53 |
| Ultraviolet absorber (UV-1) | 0.16 |
| Color stain preventing agent (Cpd-5) | 0.02 |
| Solvent (Solv-5) | 0.08 |

Seventh layer (Protective Layer)
| | |
|---|---|
| Gelatin | 1.33 |
| Acrylic modified poly(vinyl alcohol) (17% modification) | 0.17 |
| Liquid paraffin | 0.03 |
(ExY) Yellow coupler
A 1 : 1 (mol ratio) mixture of:
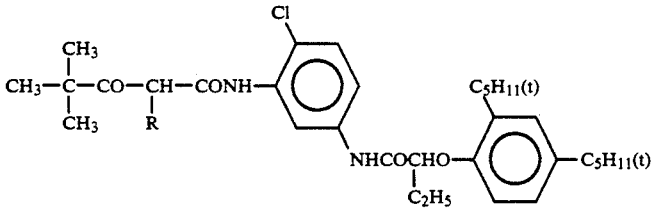
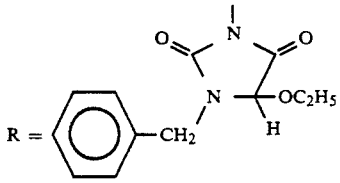
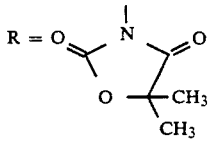
(ExM) Magenta coupler
A 1 : 1 (mol ratio) mixture of:
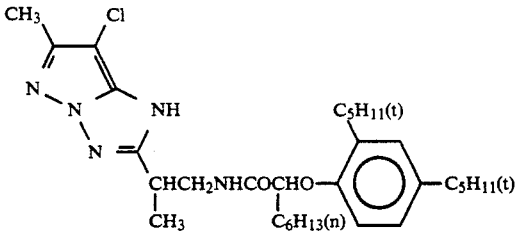
and
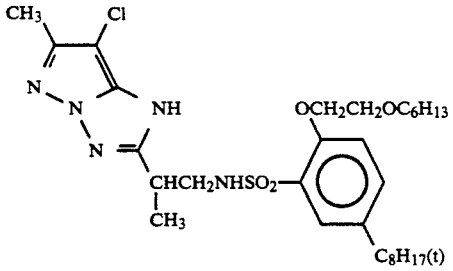
(ExC) Cyan coupler
A 2 : 4 : 4 (by weight) mixture of:
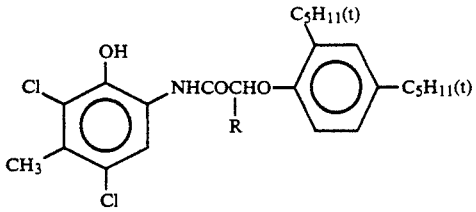
R = $C_2H_5$ and $C_4H_9$
and
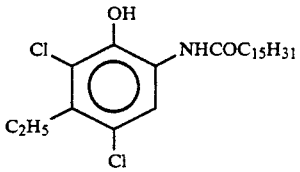
(Cpd-1) Color image stabilizer
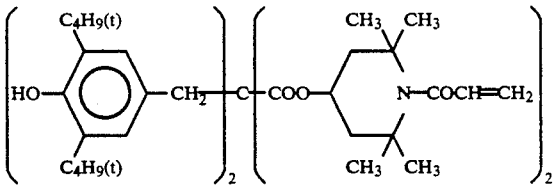
(Cpd-2) Color image stabilizer
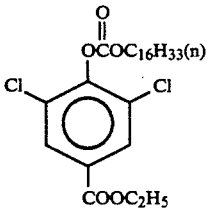

(Cpd-3) Color image stabilizer
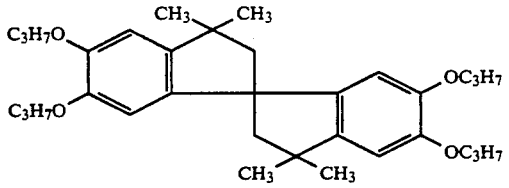
(Cpd-4) Color image stabilizer
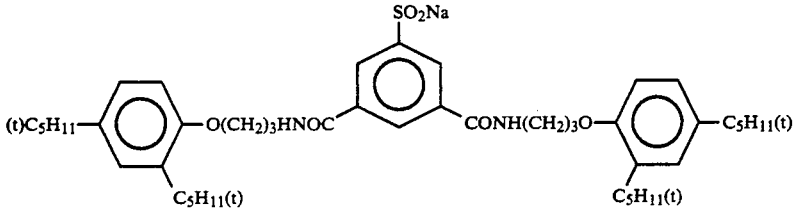
(Cpd-5) Color image stabilizer
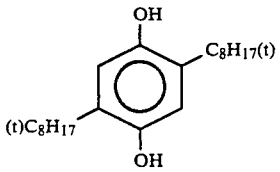
(Cpd-6) Color image stabilizer
A 2 : 4 : 4 (by weight) mixture of:
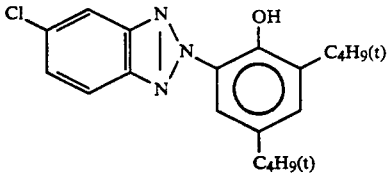
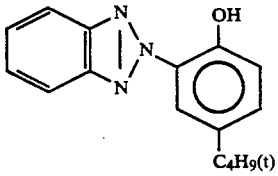
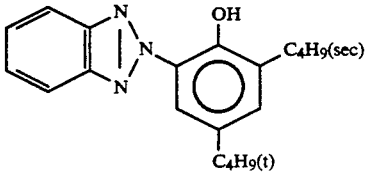
(Cpd-7) Color image stabilizer
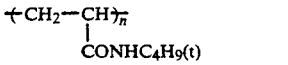
(average molecular weight: 60,000)
(Cpd-8) Color image stabilizer
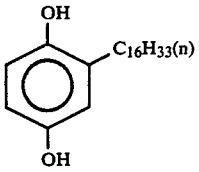
(Cpd-9) Color image stabilizer
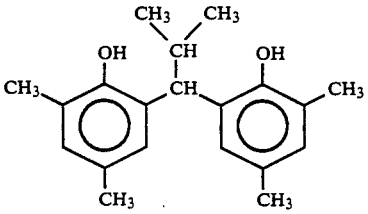
(UV-1) Ultraviolet absorber agent
A 4 : 2 : 4 (by weight) mixture of:
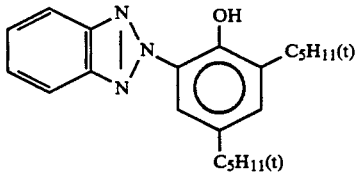
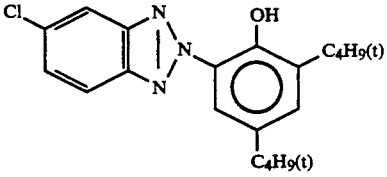
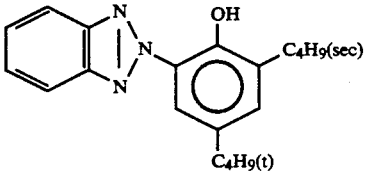

(Solv-1) Solvent

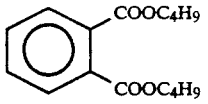

(Solv-2) Solvent

A 2 : 1 (by weight) mixture of:

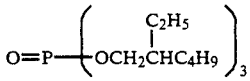

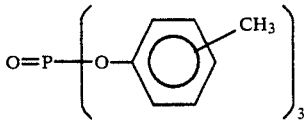

(Solv-4) Solvent

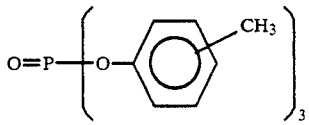

(Solv-5) Solvent

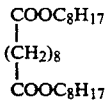

(Solv-6) Solvent

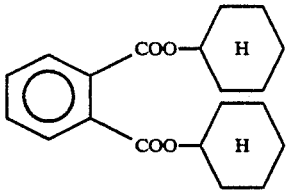

Samples 4-1 to 4-4 obtained were subjected to a stepwise exposure for sensitometric purposes through blue, green and red filters using an actinometer (model FWH available from Fuji Photo Film Co., Ltd. light source color temperature 3200° K.). Additionally, exposures were made for measuring resolution (CTF) and then they were developed and processed as indicated below. The results of density measurements of the samples obtained are shown in Table 3.

TABLE 3

| Sample No. | Support Used (Dye Used) | Relative Sensitivity Cyan | Relative Sensitivity Magenta | $D_{min}$* Cyan | $D_{min}$* Magenta | Resolution No. of Lines/mm (CTF 50%) Cyan | Resolution No. of Lines/mm (CTF 50%) Magenta | Resolution No. of Lines/mm (CTF 50%) Yellow |
|---|---|---|---|---|---|---|---|---|
| 4-1 | A (None used) | 100 | 100 | 0.02 | 0.02 | 7 | 11 | 8 |
| 4-2 | A (Comparative Dye) | 58 | 67 | 0.02 | 0.02 | 10 | 14 | 11 |
| 4-3 | B (Cpd 8 of the Invention Cpd 70 of the Invention) | 84 | 73 | 0.02 | 0.02 | 12 | 18 | 13 |
| 4-4 | C (Cpd 8 of the Invention Cpd III-3 of the Invention | 72 | 75 | 0.01 | 0.01 | 16 | 17 | 15 |

$D_{min}$* indicates ($D_{min}$ (minimum density) - Reflection Density of the Support)

Development processing was carried out continuously (in a running test) until replenishment had been carried out to the extent of twice the color development tank volume.

| Processing Operation | Temperature (°C.) | Time (sec.) | Replenisher* (ml) | Tank Capacity (l) |
|---|---|---|---|---|
| Color Development | 35 | 45 | 161 | 17 |
| Bleach-Fixing | 30–35 | 45 | 215 | 17 |
| Rinse (1) | 30–35 | 20 | — | 10 |
| Rinse (2) | 30–35 | 20 | — | 10 |
| Rinse (3) | 30–35 | 20 | 350 | 10 |
| Drying | 70–80 | 60 | | |

*Replenishment rate per square meter of photographic material.
(A three tank countercurrent system from rinse (3) → Rinse (1) was used)

The composition of each processing bath is indicated below.

| | Tank Solution | Replenisher |
|---|---|---|
| Color Development Bath | | |
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(8-methanesulfonamidoethyl)-3-methyl-4-aminoaniline sulfate | 5.0 g | 7.0 g |
| N,N-Bis(carboxymethyl)hydrazine | 5.5 g | 7.0 g |
| Brightening agent (WHITEX 4B made by Sumitomo Chemicals) | 1.0 g | 2.0 g |
| Water to make up to | 1000 ml | 1000 ml |
| pH (25° C.) | 10.05 | 10.45 |
| Bleach-Fix Bath (Tank solution = Replenisher) | | |
| Water | | 400 ml |
| Ammonium thiosulfate (70%) | | 100 ml |
| Sodium sulfite | | 17 g |
| Ammonium ethylenediaminetetraacetato ferrate | | 55 g |
| Disodium thylenediaminetetraacetate | | 5 g |
| Ammonium bromide | | 40 g |
| Water to make up to | | 1000 ml |
| pH (25° C.) | | 6.0 |
| Rinse Bath (Tank solution = Replenisher) | | |
| Ion exchanged water (calcium and magnesium both up to 3 ppm) | | |

When a dye of the present invention had been used in an anti-halation layer the fall in the sensitivity was comparatively small and there was less residual coloration. It is possible to improve resolution to a marked extent by using such quantities. Furthermore there is little residual coloration when compounds of formula (I) and formula (III) are used.

EXAMPLE 5

Sample 501, a multi-layer color photographic material of which the layer structure is indicated below was prepared on an undercoated cellulose triacetate film support.

Composition of the Light-sensitive Layer

The coated weights are the amounts indicated in units of grams of silver per square meter in the case of silver halides and colloidal silver, in units of g/m$^2$ in the case of couplers, additives and gelatin, an in units of mol per mol of silver halide in the same layer in the case of sensitizing dyes. Moreover, the symbols which indicate additives have the significance indicated hereinbelow. However, in cases where an additive has a plurality of effects it is indicated only once in a typical application.

UV: Ultraviolet absorber, solv: High boiling point organic solvent, ExF: Dye, ExS: Sensitizing dye, ExC: Cyan coupler, ExM: Magenta coupler, ExY: Yellow coupler, Cpd: Additive.

First Layer (Anti-halation Layer)

| | |
|---|---|
| Black colloidal silver | 0.15 |
| Gelatin | 2.9 |
| UV-1 | 0.03 |
| UV-2 | 0.06 |
| UV-3 | 0.07 |
| Solv-2 | 0.08 |
| ExF-1 | 0.01 |
| ExF-2 | 0.01 |

Second Layer (Low Sensitivity Red-Sensitive Emulsion Layer)

| | |
|---|---|
| Silver iodobromide emulsion (4 mol % AgI, uniform AgI type, corresponding sphere diameter 0.4 μm, variation coefficient of the corresponding sphere diameter 37%, tabular grains, diameter/thickness ratio 3.0) | 0.4 Coated weight, as silver |
| Gelatin | 0.8 |
| ExS-1 | $2.3 \times 10^{-4}$ |
| ExS-2 | $1.4 \times 10^{-4}$ |
| ExS-5 | $2.3 \times 10^{-4}$ |
| ExS-7 | $8.0 \times 10^{-4}$ |
| ExC-1 | 0.17 |
| ExC-2 | 0.03 |
| ExC-3 | 0.13 |

Third Layer (Intermediate Sensitivity Red-Sensitive Emulsion Layer

| | |
|---|---|
| Silver iodobromide emulsion (6 mol % AgI, high internal AgI type of core/shell ratio 2:1, corresponding sphere diameter 0.65 μm, variation coefficient of the corresponding sphere diameter 25%, tabular grains, diameter/thickness ratio 2.0) | 0.65 Coated weight, as silver |
| Silver iodobromide emulsion (4 mol % AgI, uniform AgI type, corresponding sphere diameter 0.4 μm, variation coeffeicient of the corresponding sphere diameter 37%, tabular grains, diameter/thickness ratio 3.0) | 0.1 Coated weight, as silver |
| Gelatin | 1.0 |
| ExS-1 | $2 \times 10^{-4}$ |
| ExS-2 | $1.2 \times 10^{-4}$ |
| ExS-5 | $2 \times 10^{-4}$ |
| ExS-7 | $7 \times 10^{-6}$ |
| ExC-1 | 0.31 |
| ExC-2 | 0.01 |
| ExC-3 | 0.06 |

Fourth Layer (High Sensitivity Red-Sensitive Emulsion Layer

| | |
|---|---|
| Silver iodobromide emulsion (6 mol % AgI, high internal AgI type of core/shell ratio 2:1, corresponding sphere diameter 0.7 μm, variation coefficient of the corresponding sphere diameter 25%, tabular grains, diameter/thickness ratio 2.5) | 0.9 Coated weight, as silver |
| Gelatin | 0.8 |
| ExS-1 | $1.6 \times 10^{-4}$ |
| ExS-2 | $1.6 \times 10^{-4}$ |
| ExS-5 | $1.6 \times 10^{-4}$ |
| ExS-7 | $6 \times 10^{-4}$ |
| ExC-1 | 0.07 |
| ExC-4 | 0.05 |
| Solv-1 | 0.07 |
| Solv-2 | 0.20 |
| Cpd-7 | $4.6 \times 10^{-4}$ |

Fifth Layer (Intermediate Layer)

| | |
|---|---|
| Gelatin | 0.6 |
| UV-4 | 0.03 |
| UV-5 | 0.04 |
| Cpd-1 | 0.1 |
| Poly(ethyl acrylate) latex | 0.08 |
| Solv-1 | 0.05 |

Sixth Layer (Low Sensitivity Green-Sensitive Emulsion Layer

| | |
|---|---|
| Silver iodobromide emulsion (4 mol % AgI, uniform AgI type, corresponding sphere diameter 0.4 μm, variation coefficient of the corresponding sphere diameter 37%, tabular grains, diameter/thickness ratio 2.0) | 0.18 Coated weight, as silver |
| Gelatin | 0.4 |
| ExS-3 | $2 \times 10^{-4}$ |
| ExS-4 | $7 \times 10^{-4}$ |
| ExS-5 | $1 \times 10^{-4}$ |
| ExM-5 | 0.11 |
| ExM-7 | 0.03 |
| ExY-8 | 0.01 |
| Solv-1 | 0.09 |
| Solv-4 | 0.01 |

Seventh Layer (Intermediate Sensitivity Green-Sensitive Emulsion Layer)

| | |
|---|---|
| Silver iodobromide emulsion (4 mol % AgI, high surface AgI type of core/shell ratio 1:1, corresponding sphere diameter | 0.27 Coated weight, as silver |

-continued

| | |
|---|---|
| 0.5 μm, variation coefficient of the corresponding sphere diameter 20%, tabular grains, diameter/ thickness ratio 4.0) | |
| Gelatin | 0.6 |
| ExS-3 | $2 \times 10^{-4}$ |
| ExS-4 | $7 \times 10^{-4}$ |
| ExS-5 | $1 \times 10^{-4}$ |
| ExM-5 | 0.17 |
| ExM-7 | 0.04 |
| ExY-8 | 0.02 |
| Solv-1 | 0.14 |
| Solv-4 | 0.02 |

Eighth Layer (High Sensitivity Green-Sensitive Emulsion Layer)

| | |
|---|---|
| Silver iodobromide emulsion (8.7 mol % AgI, multi-layer grains with a 3:4:2 silver weight ratio, silver content from the interior 24 mol %, 0 mol %, 3 mol %, corresponding sphere diameter 0.7 μm, variation coefficient of the corresponding sphere diameter 25%, tabular grains, diameter/thickness ratio 1.6) | 0.7 Coated weight, as silver |
| Gelatin | 0.8 |
| ExS-4 | $5.2 \times 10^{-4}$ |
| ExS-5 | $1 \times 10^{-4}$ |
| ExS-8 | $0.3 \times 10^{-4}$ |
| ExM-5 | 0.1 |
| ExM-6 | 0.03 |
| ExY-8 | 0.02 |
| ExC-1 | 0.02 |
| ExC-4 | 0.01 |
| Solv-1 | 0.25 |
| Solv-2 | 0.06 |
| Solv-4 | 0.01 |
| Cpd-7 | $1 \times 10^{-4}$ |

Ninth Layer (Intermediate Layer)

| | |
|---|---|
| Gelatin | 0.6 |
| Cpd-1 | 0.04 |
| Poly(ethyl acrylate) latex | 0.12 |
| Solv-1 | 0.02 |

Tenth Layer (Donor Layer for Interlayer Effect on Red-Sensitive Emulsion Layer)

| | |
|---|---|
| Silver iodobromide emulsion (6 mol % AgI, high internal AgI type of core/shell ratio 2:1, corresponding sphere diameter 0.7 μm, variation coefficient of the corresponding sphere diameter 25%, tabular grains, diameter/ thickness ratio 2.0) | 0.68 Coated weight, as silver |
| Silver iodobromide emulsion (4 mol % AgI, uniform AgI type, corresponding sphere diameter 0.4 μm, variation coefficient of the corresponding sphere diameter 37%, tabular grains, diameter/ thickness ratio 3.0) | 0.19 Coated weight, as silver |
| Gelatin | 1.0 |
| ExS-3 | $6 \times 10^{-4}$ |
| ExM-10 | 0.19 |
| Solv-1 | 0.20 |

Eleventh Layer (Yellow Filter Layer)

| | |
|---|---|
| Yellow colloidal silver | 0.06 |
| Gelatin | 0.8 |
| Cpd-2 | 0.13 |
| Solv-1 | 0.13 |
| Cpd-1 | 0.07 |
| Cpd-6 | 0.002 |
| H-1 | 0.13 |

Twelfth Layer (Low Sensitivity Blue-Sensitive Emulsion Layer)

| | |
|---|---|
| Silver iodobromide emulsion (4.5 mol % AgI, uniform AgI type, corresponding sphere diameter 0.7 μm, variation coefficient of the corresponding sphere diameter 15%, tabular grains, diameter/ thickness ratio 7.0) | 0.3 Coated weight, as silver |
| Silver iodobromide emulsion (3 mol % AgI, uniform AgI type, corresponding sphere diameter 0.3 μm, variation coefficient of the corresponding sphere diameter 30%, tabular grains, diameter/ thickness ratio 7.0) | 0.15 Coated weight, as silver |
| Gelatin | 1.8 |
| ExS-6 | $9 \times 10^{-4}$ |
| ExC-1 | 0.06 |
| ExC-4 | 0.03 |
| ExY-9 | 0.14 |
| ExY-11 | 0.89 |
| Solv-1 | 0.42 |

Thirteenth Layer (Intermediate Layer)

| | |
|---|---|
| Gelatin | 0.7 |
| ExY-12 | 0.20 |
| Solv-1 | 0.34 |

Fourteenth Layer (High Sensitivity Blue-Sensitive Emulsion Layer

| | |
|---|---|
| Silver iodobromide emulsion (10 mol % AgI, high internal AgI type, corresponding sphere diameter 1.0 μm, variation coefficient of the corresponding sphere diameter 25%, multi-twinned crystal tabular grains, diameter/thickness ratio 2.0) | 0.5 Coated weight, as silver |
| Gelatin | 0.5 |
| ExS-6 | $1 \times 10^{-4}$ |
| ExY-9 | 0.01 |
| ExY-11 | 0.20 |
| ExC-1 | 0.02 |
| Solv-1 | 0.10 |

Fifteenth Layer (First Protective Layer)

| | |
|---|---|
| Fine grained silver iodobromide emulsion (2 mol % AgI, uniform AgI type, corresponding sphere diameter 0.07 μm) | 0.12 Coated weight, as silver |
| Gelatin | 0.9 |
| UV-4 | 0.11 |
| UV-5 | 0.16 |
| Solv-5 | 0.02 |
| H-1 | 0.13 |
| Cpd-5 | 0.10 |

-continued

| | |
|---|---|
| Poly(ethyl acrylate) latex | 0.09 |

Sixteenth Layer (Second Protective Layer)

| | |
|---|---|
| Fine grained silver iodobromide emulsion (2 mol % AgI, uniform AgI type, corresponding sphere diameter 0.07 μm) | 0.36 Coated weight, as silver |
| Gelatin | 0.55 |
| Poly(methyl methacrylate) particles (diameter 1.5 μm) | 0.2 |
| H-1 | 0.17 |

In addition to the components indicated above, 0.07 g/m$^2$ of the emulsions stabilizer Cpd-3 and 0.03 g/m$^2$ of the surfactant Cpd-4 as coating promotor were added to each layer.

UV-1

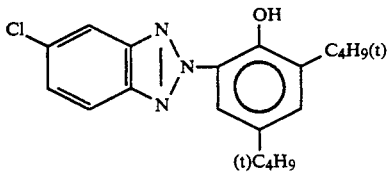

UV-2

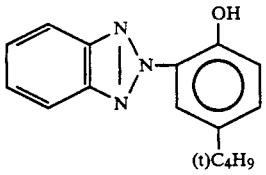

-continued

UV-3

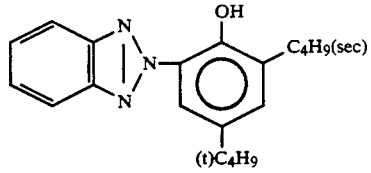

UV-4

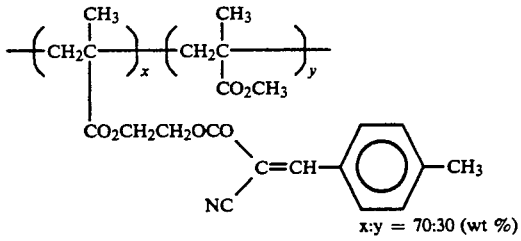

x:y = 70:30 (wt %)

UV-5

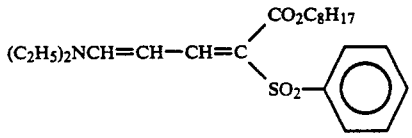

Solv-1 Tricresyl phosphate

Solv-2 Dibutyl phthalate

Solv-4

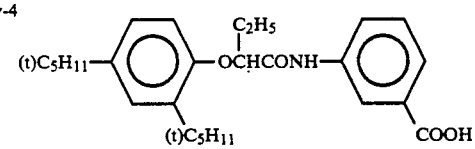

Solv-5 Trihexyl phosphate

ExF-1

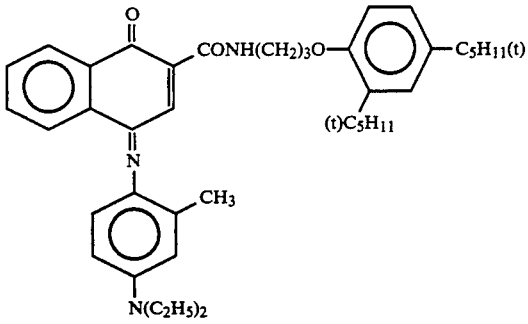

ExF-2

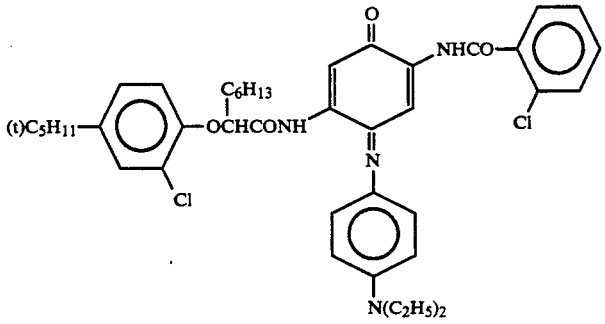

-continued
ExS-1
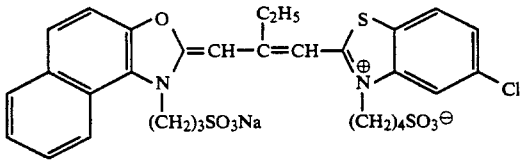
ExS-2
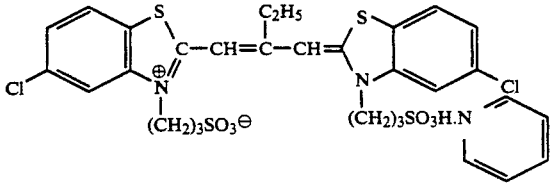
ExS-3
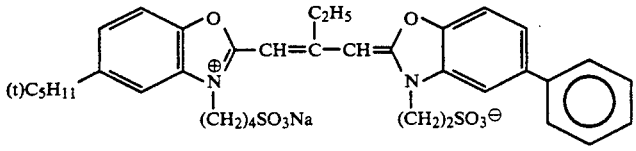
ExS-4
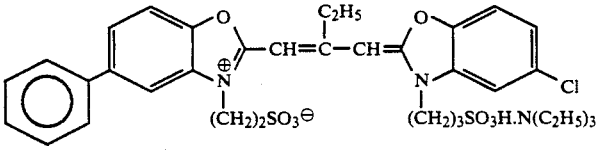
ExS-5
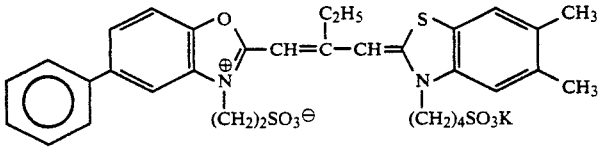
ExS-6
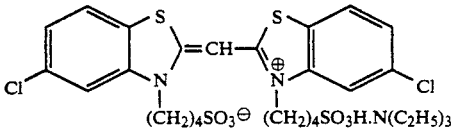
ExS-7
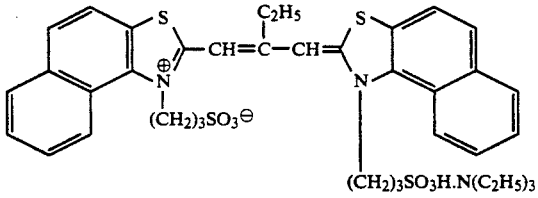
ExS-8
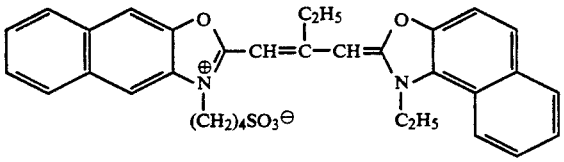
ExC-1
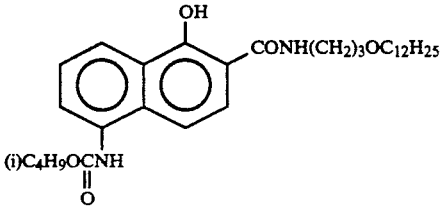

-continued
ExC-2
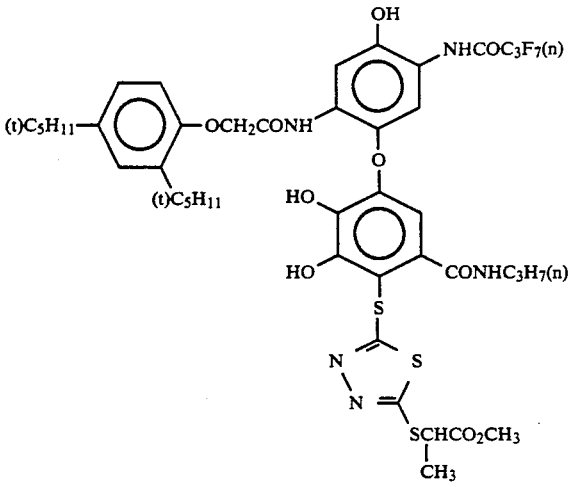
ExC-3
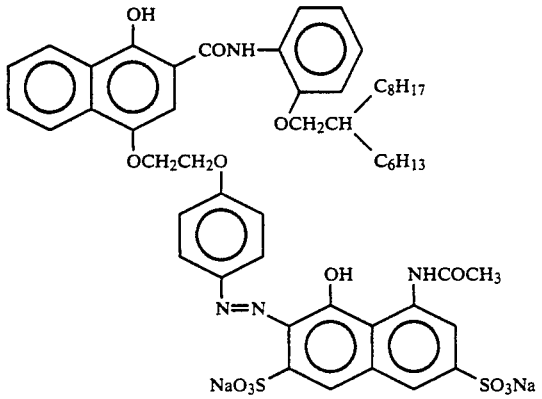
ExC-4
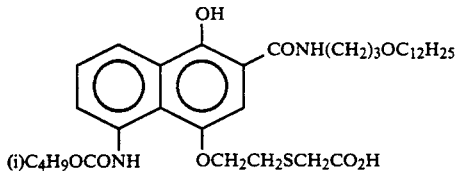
ExM-5
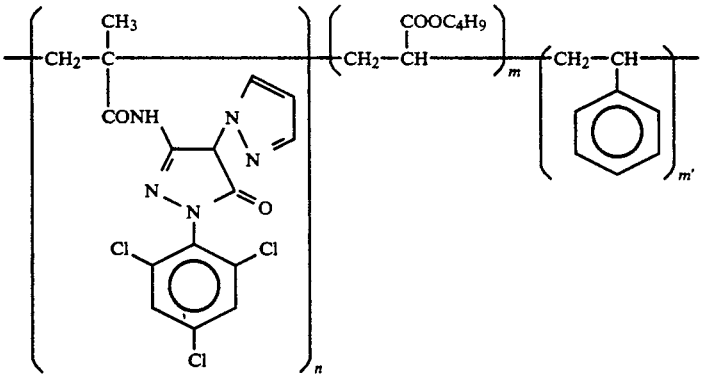
n = 50
m = 25
m' = 25
mol. wt about 20,000

-continued
ExM-6
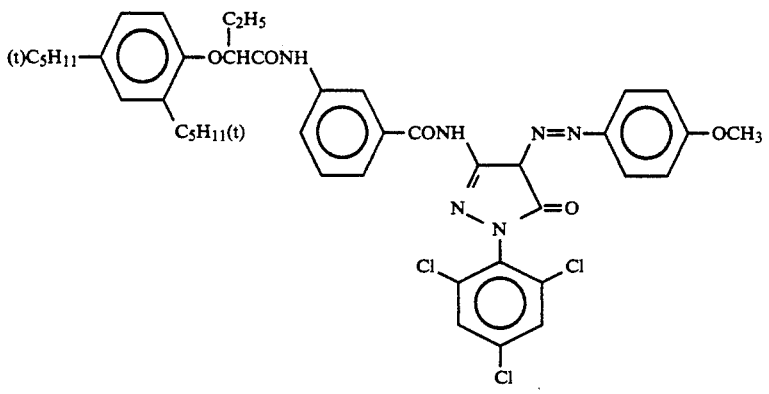
ExM-7
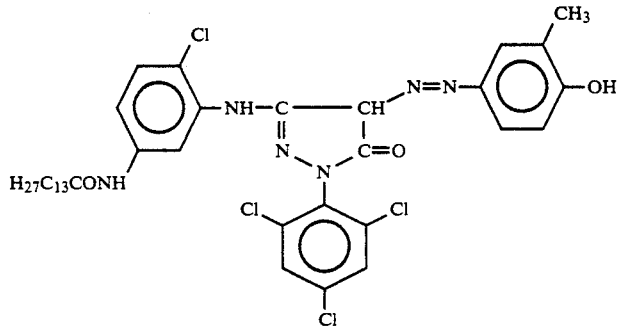
ExM-10
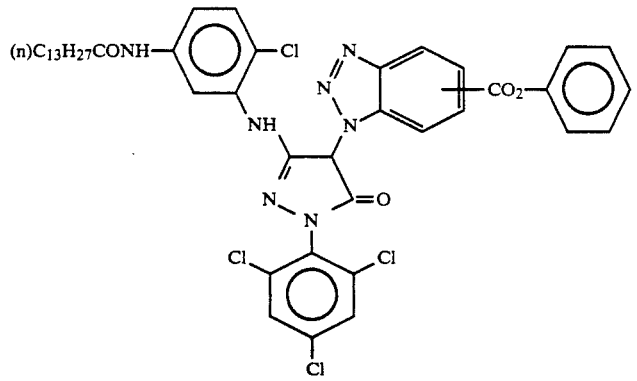
ExY-8
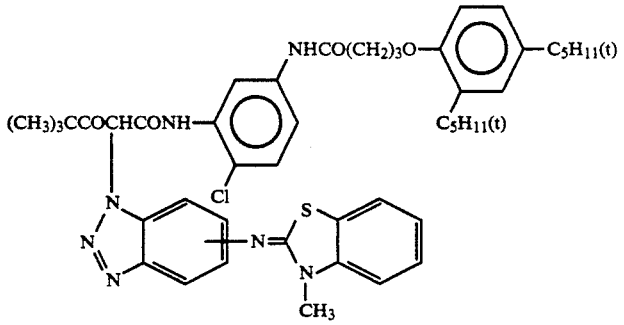

-continued
ExY-9
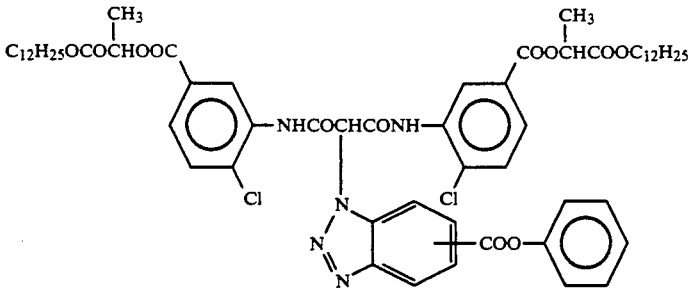
ExY-11
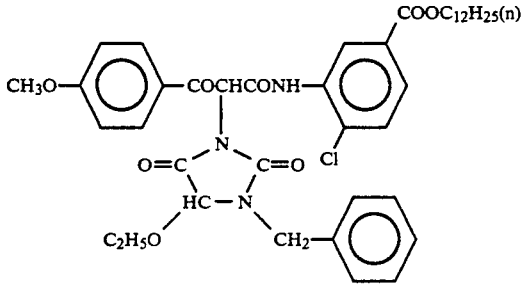
ExY-12
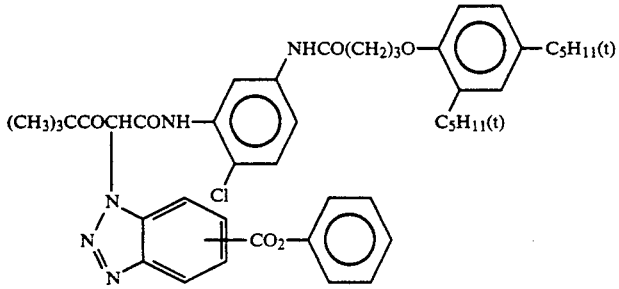
Cpd-7
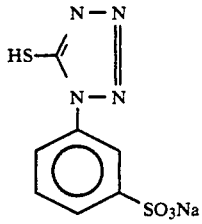
Cpd-1
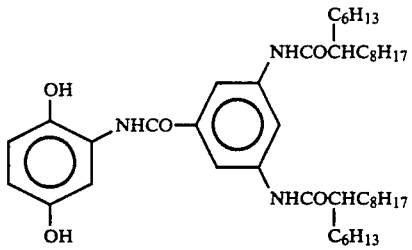
Cpd-2
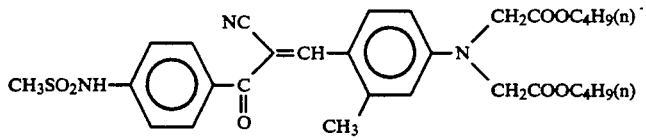
Cpd-6
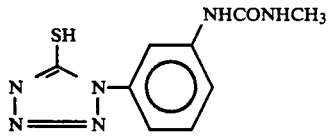
Cpd-8
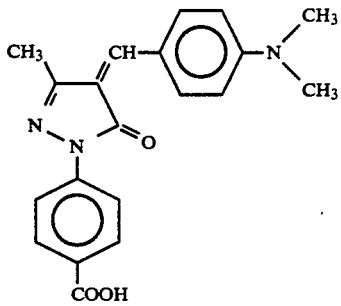

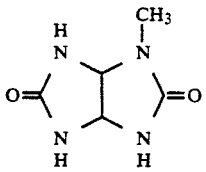

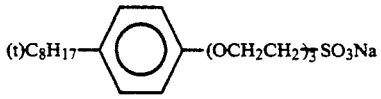

Moreover, Cpd-2 in the eleventh layer, was dissolved by heating to 60° C. in ethyl acetate together with Cpd-1 and Solv-1 and the solution was emulsified and dispersed using a domestic mixer in an aqueous gelatin solution which contained sodium dodecylbenzenesulfonate and mixed with the silver halide emulsion.

Preparation of Sample 502

An equimolar amount with Cpd-2 of Compound 1 of the present invention was used to replace Cpd-2 in the eleventh layer of Sample 501. The method used to disperse Compound 1 of the present invention is described below. Moreover, a dispersion of Cpd-1 and Solv-1 excluding Cpd-2 was obtained in the same way as when preparing Sample 501. Otherwise, Sample 502 was prepared in the same way as Sample 501.

Method of Dispersing Compound 1 of the Present Invention

Liquid I

| | |
|---|---|
| Compound 1 of the present invention | 20 g |
| Methyl ethyl ketone | 200 cc |

Liquid II

| | |
|---|---|
| Gelatin | 100 g |
| Water | 900 ml |
| Sodium dodecylbenzenesulfonate | 10 g |

Liquid I was introduced into the barrel of a hypodermic syringe and jetted into liquid II through a nozzle of mouth diameter 0.2 mm and a fine dispersion of Compound 1 was obtained. The methyl ethyl ketone and sodium dodecylbenzenesulfonate were removed from this dispersion using an ultra-filtration membrane.

Preparation of Sample 503

Sample 503 was prepared in the same way as sample 502 except that Compound 3 of the present invention was used instead of Compound 1 of the present invention in the eleventh layer of Sample 502.

Preparation of Sample 504

Sample 504 was prepared in the same way as sample 502 except that Cpd-8 was used instead of Compound 1 of the present invention in the eleventh layer of Sample 502.

The color photographic material Samples 501 to 504 obtained in this way were exposed and then processed using the procedure indicated in Table 4.

-continued

Cpd-5

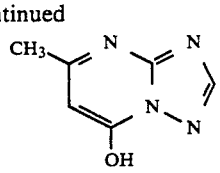

Cpd-3

Cpd-4

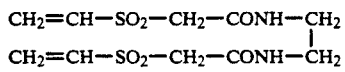

H-1

TABLE 4

| Process | Processing Time | Processing Temperature (°C.) |
|---|---|---|
| Color Development | 3 min. 15 sec. | 38 |
| Bleaching | 1 min. 00 sec. | 38 |
| Bleach-Fixing | 3 min. 15 sec. | 38 |
| Water Wash (1) | 40 sec. | 35 |
| Water Wash (2) | 1 min. 00 sec. | 35 |
| Stabilization | 40 sec. | 38 |
| Drying | 1 min. 15 sec. | 55 |

The composition of the processing baths in indicated below.

| | (Units: Grams) |
|---|---|
| Color Development Bath | |
| Diethylenetriamine penta-acetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-Ethyl-N-(β-hydroxyethyl)amino]-2-methylaniline sulfate | 4.5 |
| Water | to make up to 1.0 l |
| pH | 10.05 |
| Bleach Bath | |
| Ammonium ethylenediaminetetraacetato ferrate di-hydrate | 120.0 |
| Disodium ethylenediaminetetraacetate | 10.0 |
| Ammonium bromide | 100.0 |
| Ammonium nitrate | 10.0 |
| Bleach accelerator | 0.005 mol |

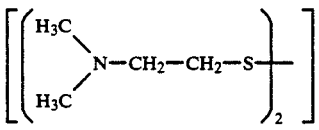

| | |
|---|---|
| Aqueous ammonia (27%) | 15.0 ml |
| Water | to make up to 1.0 l |
| pH | 6.3 |
| Bleach Fixer | |
| Ammonium ethylenediaminetetraacetato ferrate di-hydrate | 50.0 |
| Disodium ethylenediaminetetraacetate | 5.0 |
| Sodium sulfite | 12.0 |
| Aqueous ammonium thiosulfate solution (70%) | 240.0 ml |
| Aqueous ammonia (27%) | 6.0 ml |
| Water | to make up to 1.0 l |
| pH | 7.2 |

Water Wash Bath

Town water was passed through a mixed bed type column which had been packed with an H-type strongly acidic cation exchange resin (Amberlite IR-120B, available from Rohm and Haas Co.) and an OH-type anion exchange resin (Amberlite IR-400, available from Rohm & Haas Co.) and treated in such a way that the calcium and magnesium ion concentrations were up to 3 mg/liter, after which 20 mg/liter of sodium cyanurate dichloride and 1.5 g/liter of sodium sulfate were added. The pH of this liquid was within the range from 6.5 to 7.5.

| Stabilizing Bath | (Units: Grams) |
|---|---|
| Formalin (37%) | 2.0 ml |
| Polyoxyethylene p-monononylphenyl ether (average degree of polymerization 10) | 0.3 |
| Disodium ethylenediaminetetraacetate | 0.05 |
| Water | to make up to 1.0 l |
| pH | 5.0–8.0 |

The samples obtained were examined sensitometrically and the results shown in Table 5 were obtained.

TABLE 5

| Sample No. | Dye used | Relative Sensitivity Yellow | Residual* Coloration* Yellow |
|---|---|---|---|
| 501 | Cpd-2 (Comparative Ex.) | 100 | 0.06 |
| 502 | Compound 1 of the invention (Invention) | 105 | 0.01 |
| 503 | Compound 2 of the invention (Invention) | 116 | 0.02 |
| 504 | Cpd-8 (Comparative Ex.) | 104 | 0.03 |

Residual Coloration*: [$D_{min}$ (minimum density) obtained on processing in this example]-[$D_{min}$ obtained on processing for 10 minutes in a bath of SS 30 grams/liter]

When used as filter dyes, the dyes of the present invention (Samples 502 and 503) produced little loss of photographic sensitivity and it was possible to obtain color photographic light-sensitive materials with which there was little residual coloration. In contrast, Comparative Samples 501 and 504 had significantly higher residual coloration.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive element comprising a support having provided thereon at least one silver halide emulsion layer and at least one hydrophilic colloid emulsion layer comprising at least one dye in the form of a fine powder dispersion and represented by the following formula (i):

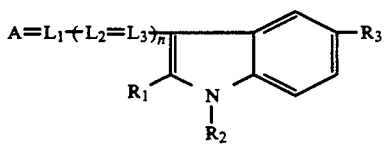

(i)

wherein A represents an acidic nucleus selected from the group consisting of 5-pyrazolone, isooxazolone, barbituric acid, thiobarbituric acid, rhodanine, hydantoin, thiohydantoin, oxazolidindione, pyrazolidindione,indandione, pyrazolopyridone, 1,2,3,4-tetrahydroquinolin-2,4-dione, 3-oxo-2,3-dihydrobenzo[d]thiophene-1,1-dioxide, and 3-dicynaomethine-2,3-dihydroxybenzo[d]thiophene-1,1-dioxide; $R_1$ and $R_2$ each represents an alkyl, aryl or alkoxycarbonyl group, or hydrogen; $R_3$ represents an alkyl, alkoxy, or nitro group, hydrogen or a halogen; $L_1$, $L_2$ and $L_3$ represent a methine group; n represents 0 or 1; and wherein said dye further comprises at least one selected from the group consisting of a carboxyl group, a sulfonamido group and a sulfamoyl group, and wherein said dye is present in an amount of 1 to 1000 mg/m$^2$ of said light sensitive element.

2. A silver halide photographic light-sensitive element according to claim 1, wherein said dye of formula (I) is a dye of the following formula (ii):

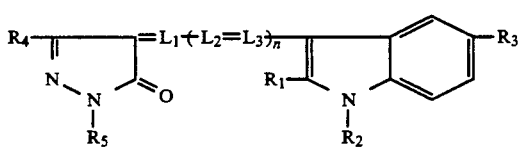

(ii)

wherein $R_1$, $R_2$ and $R_3$ each has the same significance as $R_1$, $R_2$, and $R_3$ in claim 1; $R_4$ represents an alkyl, aryl, alkoxycarbonyl, aryloxycarbonyl, alkoxy, aryloxy, acyl, hydroxy, acylamino, cyano, ureido or amino group; $R_5$ represents an aryl or aralkyl group; $L_1$, $L_2$, $L_3$ and n each has the same significance as $L_1$, $L_2$, $L_3$ and n in claim 1; and wherein said dye further comprises at least one group selected from the group consisting of a carboxy, sulfonamido and sulfamoyl group.

3. A silver halide photographic light-sensitive element according to claim 1, wherein A represents a pyrazolopyridone nucleus.

4. A silver halide photographic light-sensitive element comprising a support having provided thereon at least one silver halide emulsion layer and at least one hydrophilic colloid layer comprising (A) at least one first fine powder dispersion of a first dye according to formula (ii):

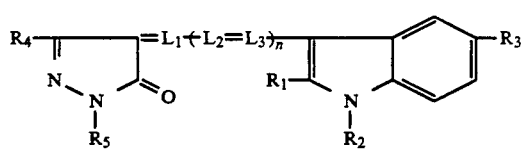

(ii)

wherein $R_1$ and $R_2$ each represents an alkyl, aryl or alkoxycarbonyl group, or a hydrogen atom; $R_3$ represents an alkyl, alkoxy or nitro group, or a hydrogen or halogen atom; $R_4$ represents an alkyl, aryl, alkoxycarbonyl, aryloxycarbonyl, alkoxy, aryloxy, acyl, hydroxy, acylamino, cyano, ureido or amino group; $R_5$ represents an aryl or aralkyl group; $L_1$, $L_2$, $L_3$, each represents a methine group; n represents 0 or 1; and wherein said first dye comprises at least one group selected from the group consisting of a carboxy, sulfonamido and sulfamoyl group; and (B) at least one second fine powder dispersion of a second dye according to formula (iii):

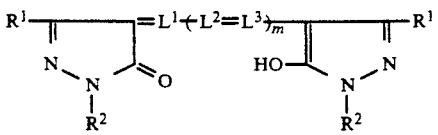

(iii)

wherein $R_1$, $R_2$, $L_2$ and $L_3$ each has the same significance as $R_1$, $R_2$, $L_2$ and $L_3$ in formula (ii), m represents 0, 1 or 2; and wherein said second dye further comprises at least one group selected from the group consisting of a carboxyl group, a sulfonamido group and a sulfamoyl group, and wherein said first dye and said second dye are each present in an amount of 1 to 1000 mg/m$^2$ of said light sensitive material.

* * * * *